US005174261A

United States Patent [19]

Fujii et al.

[11] Patent Number: 5,174,261

[45] Date of Patent: Dec. 29, 1992

[54] FUEL INJECTION QUANTITY CONTROL DEVICE FOR TWO CYCLE ENGINES

[75] Inventors: Takaaki Fujii; Osamu Kudou; Sumitaka Ogawa; Hiroshi Uike, all of Saitama, Japan

[73] Assignee: Honda Giken Kogyo Kabushiki Kaisha, Tokyo, Japan

[21] Appl. No.: 720,689

[22] Filed: Jun. 25, 1991

[30] Foreign Application Priority Data

Jun. 25, 1990 [JP] Japan ..... 2-166192

[51] Int. Cl.[5] ..... F02D 17/00; F02D 41/26; F02P 5/15

[52] U.S. Cl. ..... 123/435; 123/73 A; 123/479

[58] Field of Search ..... 123/73 A, 73 C, 198 D, 123/198 F, 481, 478, 479, 435, 425; 73/115

[56] References Cited

U.S. PATENT DOCUMENTS 4,989,554 2/1991 Kushida et al. ..... 123/479 X

FOREIGN PATENT DOCUMENTS 56-23548 3/1981 Japan .
62-30932 2/1987 Japan .
63-208644 8/1988 Japan .

*Primary Examiner*—Tony M. Argenbright

[57] ABSTRACT

A fuel injection quantity control device for use with a two cycle engine being rotatably driven by receiving a fuel-air mixture injected into the engine based on fuel injection quantity instruction signals and the air supplied through an intake passage and ignition of the fuel-air mixture in a combustion chamber includes a rotational speed Ne detection device for detecting the rotational speed Ne of the two cycle engine and for generating a rotational speed Ne signal. An opening Θ detection device is provided for detecting the opening Θ of a throttle provided in an intake passage for regulating the supply of air and for generating an opening Θ signal. A basic injection quantity setting device is provided for setting a basis injection quantity of the fuel based on the rotational speed, Ne signal and the opening Θ signal. A fuel-air mixture condition judging device judges the conditions of the fuel-air mixture and an injection quantity instruction signal generating device corrects the basic injection quantity to reduce the quantity in response to misfire in said fuel-air mixture for changing the conditions of the fuel-air mixture to ignition, and outputs the corrected basic injection quantity as an injection quantity instruction signal the fuel-air mixture condition judging device judges a misfire at the present time based on a misfire in the past.

23 Claims, 22 Drawing Sheets

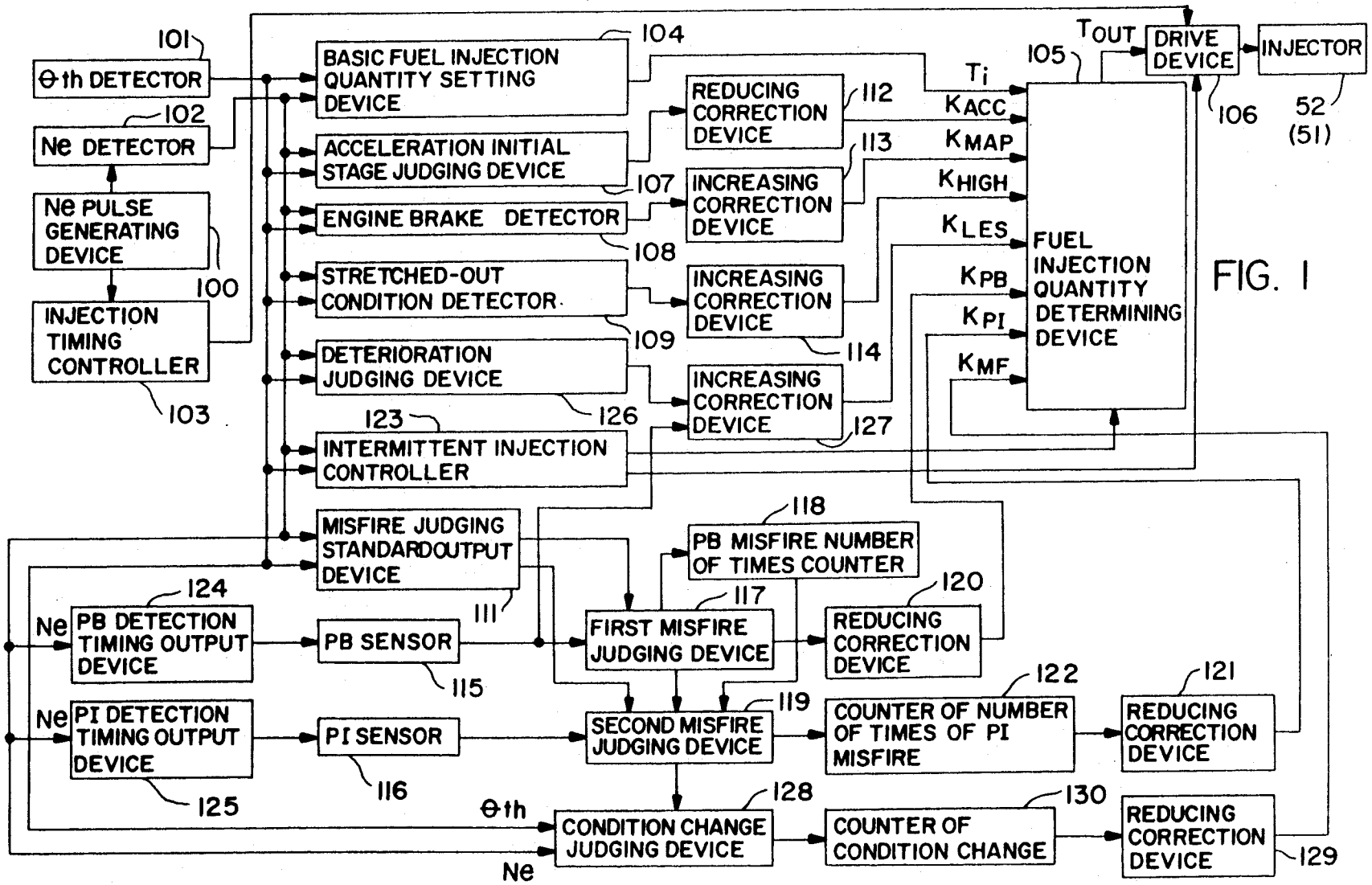
INJECTOR
52 (51)
DRIVE DEVICE
106
FIG. 1
TOUT
105
FUEL INJECTION QUANTITY DETERMINING DEVICE
Ti
KACC
KMAP
KHIGH
KLES
KPB
KPI
KMF
REDUCING CORRECTION DEVICE
112
INCREASING CORRECTION DEVICE
113
INCREASING CORRECTION DEVICE
114
INCREASING CORRECTION DEVICE
127
PB MISFIRE NUMBER OF TIMES COUNTER
118
REDUCING CORRECTION DEVICE
120
COUNTER OF NUMBER OF TIMES OF PI MISFIRE
122
REDUCING CORRECTION DEVICE
121
COUNTER OF CONDITION CHANGE
130
REDUCING CORRECTION DEVICE
129
BASIC FUEL INJECTION QUANTITY SETTING DEVICE
104
ACCELERATION INITIAL STAGE JUDGING DEVICE
107
ENGINE BRAKE DETECTOR
108
STRETCHED-OUT CONDITION DETECTOR
109
DETERIORATION JUDGING DEVICE
126
INTERMITTENT INJECTION CONTROLLER
123
MISFIRE JUDGING STANDARD OUTPUT DEVICE
111
FIRST MISFIRE JUDGING DEVICE
117
SECOND MISFIRE JUDGING DEVICE
119
CONDITION CHANGE JUDGING DEVICE
128
PB SENSOR
115
PI SENSOR
116
θth
Ne
θth DETECTOR
101
Ne DETECTOR
102
Ne PULSE GENERATING DEVICE
100
INJECTION TIMING CONTROLLER
103
PB DETECTION TIMING OUTPUT DEVICE
124
PI DETECTION TIMING OUTPUT DEVICE
125
Ne
Ne

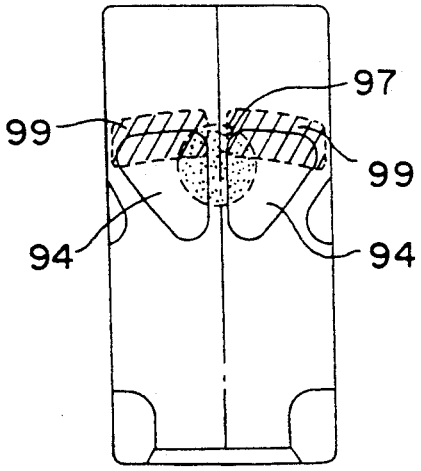
FIG. 5B
FIG. 6A
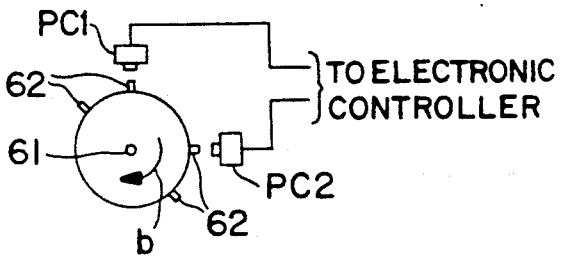
FIG. 6B
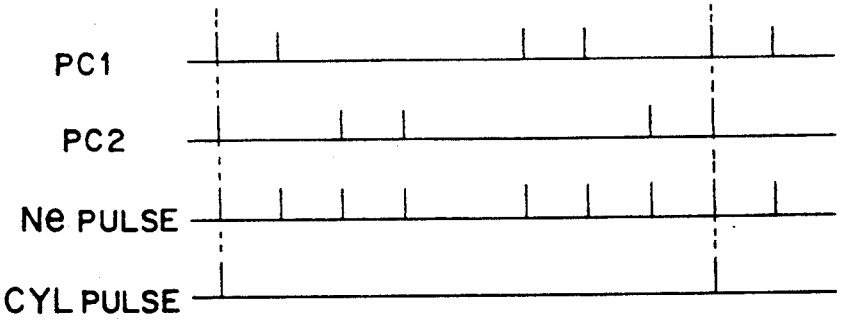
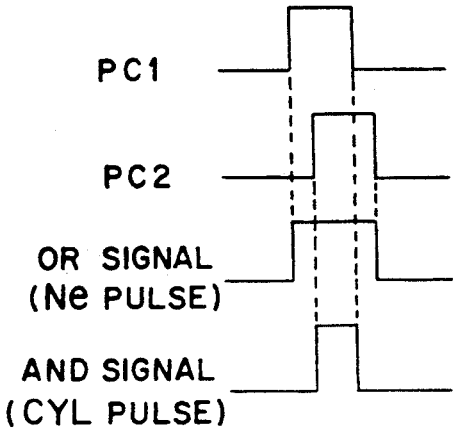
FIG. 7

INCREASING AND REDUCING CORRECTION

Ne>7000rpm
S301
Ne<10000rpm
S302
Δθth FETCH
S303
Δθth ≧ G
S304
XKACC =1
S305
XTHCL =1
S306
1 → XKACC
S307
KACC CALCULATE
S308
KACC NKHLD CALCULATE
S309
TOUT *KACC → TOUT
S310
XKACC =1
S311
NKHLD =0
S312
NKHLD-1 → NKHLD
S313
KACC +ΔKACC → KACC
S314
KACC < 1
S315
1.0 → KACC
S316
"0" → XKACC
S317
FINISH
Y
N

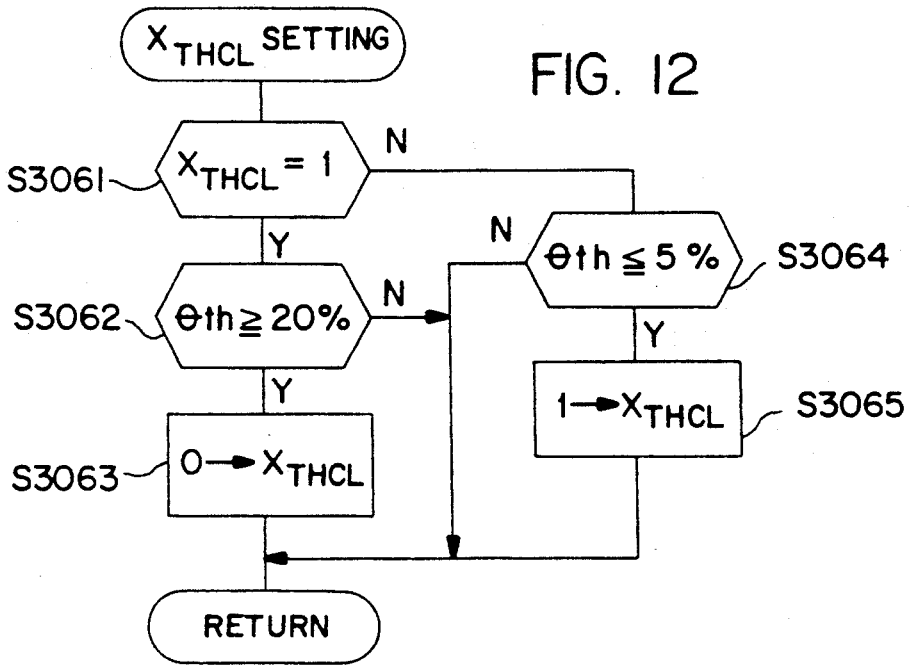
FIG. 13
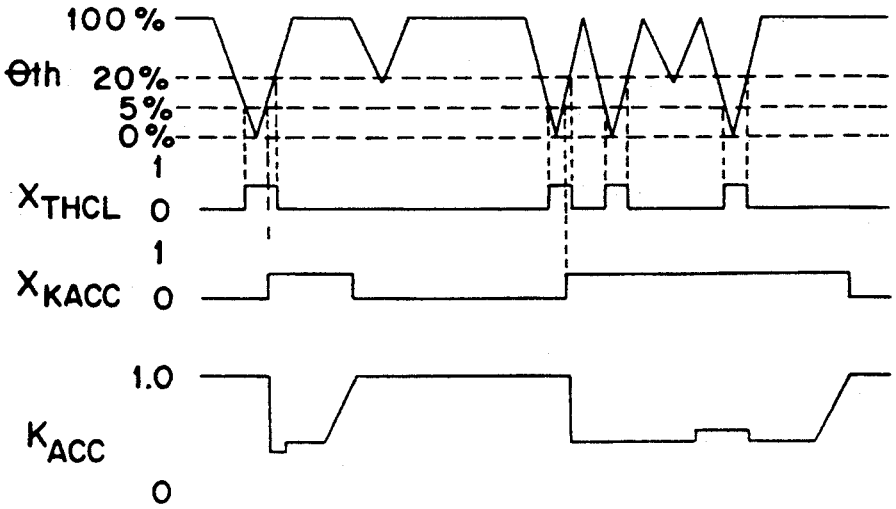

| ROTATIONAL SPEED(rpm) | 7000~8000 | 8000~9000 | 9000~10000 |
|---|---|---|---|
| $N_{KHLD}$ | N1 | N2 | N3 |
| $\Delta K_{ACC}$ | ΔK1 | ΔK2 | ΔK3 |

| ROTATIONAL SPEED(rpm) | 7000~8000 | 8000~9000 | 9000~10000 |
|---|---|---|---|
| $N_{KHLD}$ | N1 | N2 | N3 |
| $\Delta K_{ACC}$ | ΔK1 | ΔK2 | ΔK3 |
| $K_{ACC}$ | K1 | K2 | K3 |

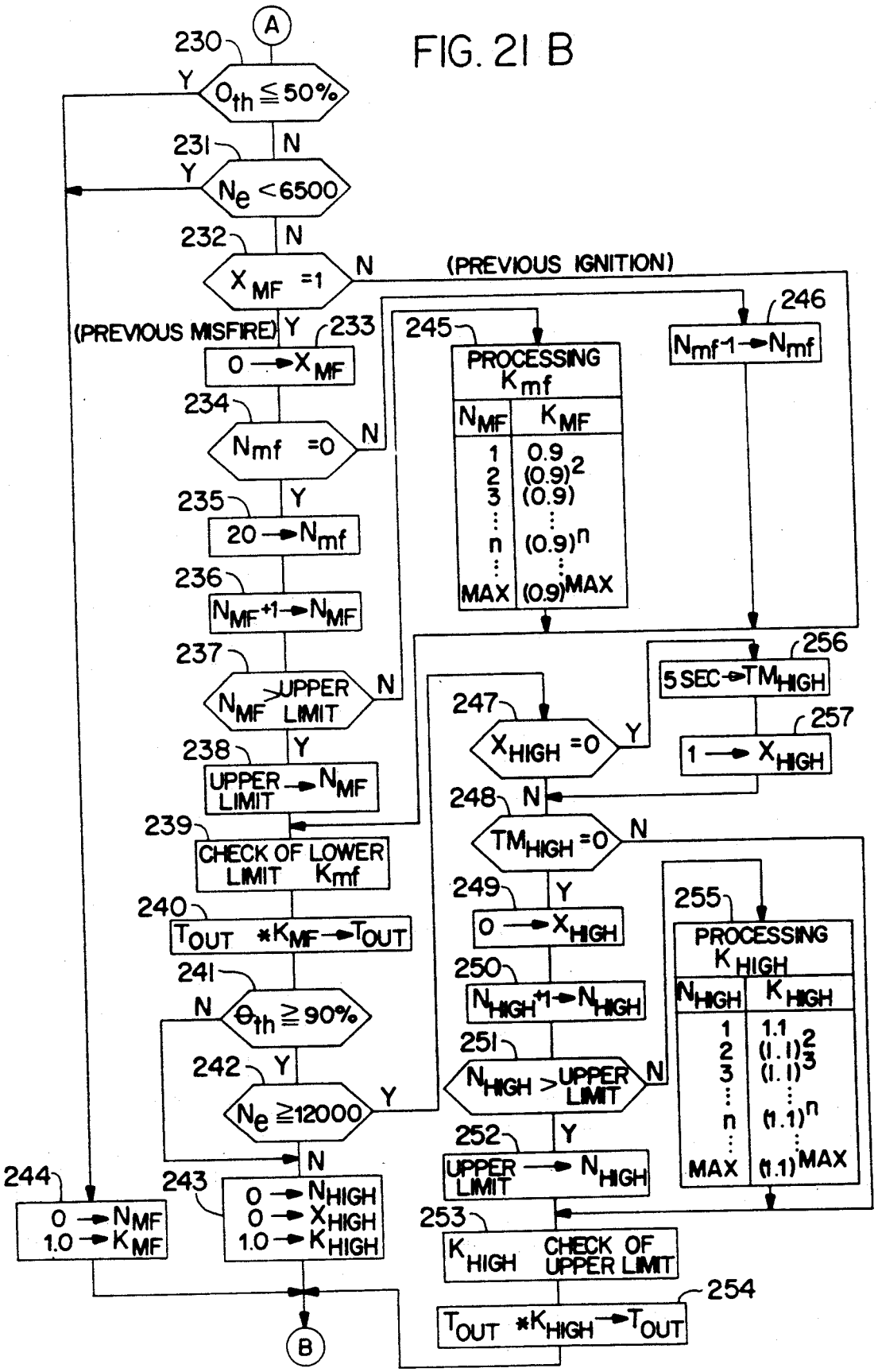
FIG. 21 B
A
230
$\theta_{th} \leq 50\%$
Y
N
231
$N_e < 6500$
Y
N
232
$X_{MF} = 1$
N
(PREVIOUS IGNITION)
(PREVIOUS MISFIRE) Y
233
$0 \rightarrow X_{MF}$
234
$N_{mf} = 0$
N
Y
235
$20 \rightarrow N_{mf}$
236
$N_{MF}+1 \rightarrow N_{MF}$
237
$N_{MF}$ > UPPER LIMIT
N
Y
238
UPPER LIMIT $\rightarrow N_{MF}$
239
CHECK OF LOWER LIMIT $K_{mf}$
240
$T_{OUT} * K_{MF} \rightarrow T_{OUT}$
241
$\theta_{th} \geq 90\%$
N
Y
242
$N_e \geq 12000$
Y
N
243
$0 \rightarrow N_{HIGH}$
$0 \rightarrow X_{HIGH}$
$1.0 \rightarrow K_{HIGH}$
244
$0 \rightarrow N_{MF}$
$1.0 \rightarrow K_{MF}$
B
245
PROCESSING $K_{mf}$
$N_{MF}$ | $K_{MF}$
1 | 0.9
2 | $(0.9)^2$
3 | (0.9)
n | $(0.9)^n$
MAX | $(0.9)^{MAX}$
246
$N_{mf}-1 \rightarrow N_{mf}$
247
$X_{HIGH} = 0$
Y
N
248
$TM_{HIGH} = 0$
N
Y
249
$0 \rightarrow X_{HIGH}$
250
$N_{HIGH}+1 \rightarrow N_{HIGH}$
251
$N_{HIGH}$ > UPPER LIMIT
N
Y
252
UPPER LIMIT $\rightarrow N_{HIGH}$
253
$K_{HIGH}$ CHECK OF UPPER LIMIT
254
$T_{OUT} * K_{HIGH} \rightarrow T_{OUT}$
255
PROCESSING $K_{HIGH}$
$N_{HIGH}$ | $K_{HIGH}$
1 | 1.1
2 | $(1.1)^2$
3 | $(1.1)^3$
n | $(1.1)^n$
MAX | $(1.1)^{MAX}$
256
5 SEC $\rightarrow TM_{HIGH}$
257
$1 \rightarrow X_{HIGH}$

FUEL INJECTION QUANTITY CONTROL DEVICE FOR TWO CYCLE ENGINES

BACKGROUND OF THE INVENTION

1. Field of the Invention

This invention relates to a fuel injection quantity control device for two cycle engines, and in particular to the fuel injection quantity control device which employs an electronic fuel injection quantity control device for two cycle engines.

2. Description of the Background Art

In two cycle engines which employ an electronic fuel injection quantity control device as described in Japanese Patent Laid-Open Publication, No. 63-208644, a subsequent fuel injection quantity is reduced in order to eliminate a state of misfire.

In the above described publication when the state of misfire is eliminated and the engine returns once more to the state of ignition, reducing correction of fuel injection quantity is not made, but in the state of ignition the ratio of air to fuel is not necessarily the most suitable at the shift from the state of misfire to the state of ignition. It often happens that the state in which misfire is liable to develop is still maintained.

In the prior art described above there has been a problem in that the probability that misfire again develops is high right after the shift to the state of ignition from the state of misfire.

SUMMARY OF THE INVENTION

A purpose of the invention is to solve the above-mentioned problem by providing a fuel injection quantity control device for two cycle engines in which misfire can be eliminated for sure.

In order to achieve the above purpose the present invention provides an electronic fuel injection device. The two cycle engine which employs this electronic injection device is provided with the following devices:

(1) A device to set basic fuel injection quantity based on the engine's rotational speed and the opening of the throttle valve, a misfire judging device to judge misfire, a condition change judging device to judge the change of condition from misfire to ignition, and a reducing correction device to reduce the above-mentioned basic fuel injection quantity.

(2) A condition change judging counter to count the number of times of condition change judging from misfire to ignition by means of the above-mentioned condition change judging device. The above-mentioned reducing correction device reduces gradually the above-mentioned basic fuel injection quantity in response to the count value of the condition change judging counter.

(3) The reducing correction for the basic fuel injection quantity is arranged so as to prohibit the correction when the engine's rotational speed is low and the opening of the throttle is small.

(4) The count value of the condition change judging counter is reset when the engine's rotational speed is low and the opening of the throttle is small.

According to (1), when the fuel-air mixture returns to the state in which it is liable to cause misfire again such as right after the state of ignition is restored after misfire, the fuel injection quantity is reduced for elimination of misfire.

According to (2), since the air to fuel ratio gradually approaches a ratio to provide the state of stable ignition, the elimination of misfire is further assured.

According to the above-mentioned (3) and (4), the above explained reducing correction for the basic fuel injection quantity is not made if the engine's rotational speed is low and the opening of the throttle is small, even when the condition has just changed from misfire to ignition so that the air to fuel ratio does not become unnecessarily thin.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a block diagram of the functions of the invention;

FIGS. 4, 5A and 5B show a partial enlargement of the rear bank of an embodiment of the invention;

FIGS. 6A, 6B and 7 show drawings for the explanation of Ne pulse and CYL pulse;

FIG. 12 is a flow chart of setting acceleration initial flag $X_{THCL}$;

FIG. 13 is a timing chart of the acceleration reducing correction;

FIG. 21A and FIG. 21B are flow charts in detail of the misfire correction;

DETAILED DESCRIPTION OF THE PREFERRED EMBODIMENT

With reference to the attached drawings the invention will be described in detail by way of an embodiment in which the invention is applied to a V-engine.

Figure 2:
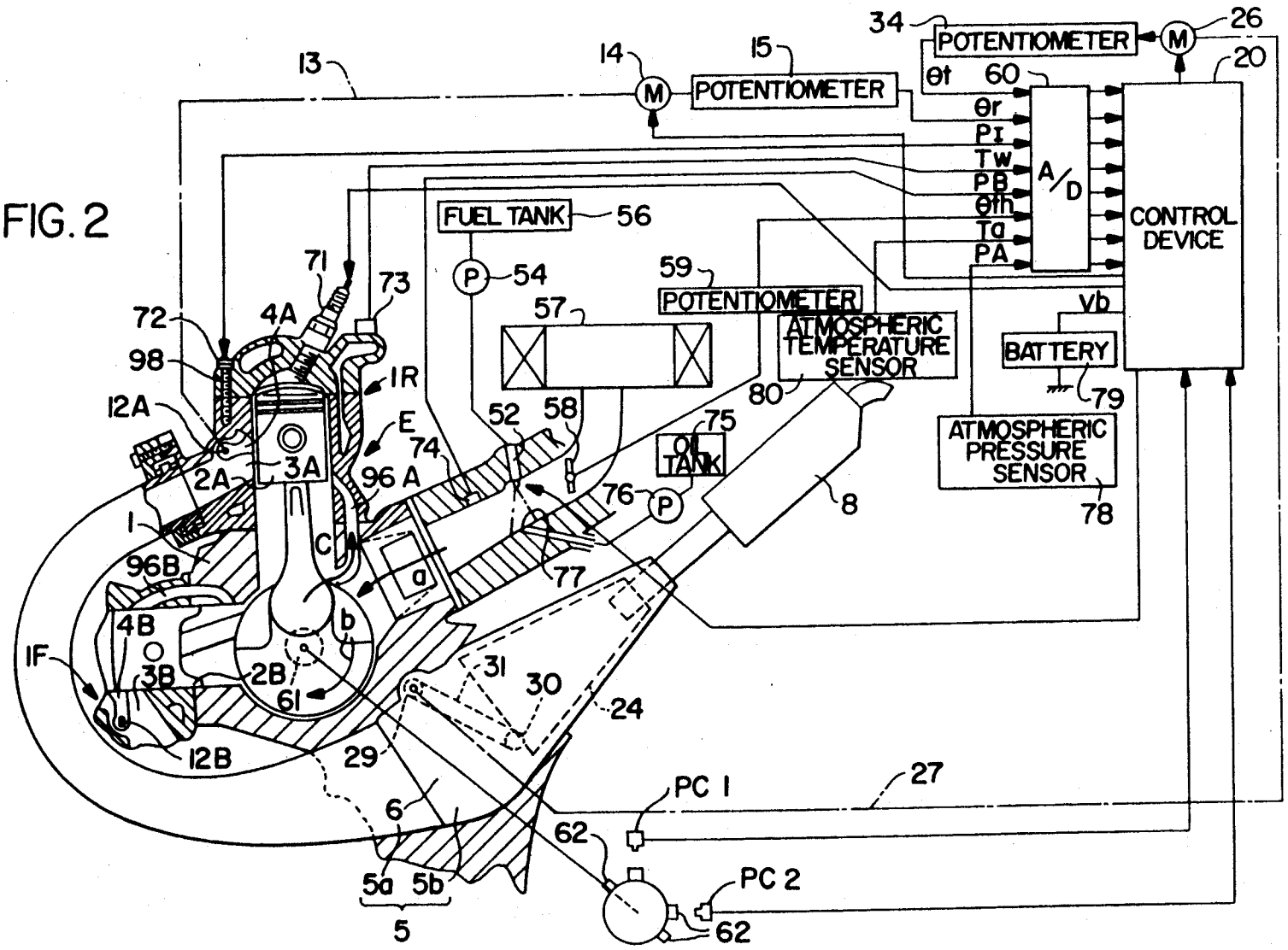
FIG. 2 is schematic diagram to show the constitution of an embodiment of the invention.

FIG. 2 is a schematic diagram which shows an embodiment of the invention. A two cycle engine E which is installed on an autobicycle has two cylinders, namely, a front side cylinder (front bank, called hereinafter F bank) 1F and rear side cylinder (rear bank, hereinafter called R bank) 1R.

For purposes of illustration, part of the F bank 1F and an air suction channel to be connected to this F bank 1F are omitted from FIG. 2. The ignition timings of the F bank 1F and the R bank 1R of this two cycle V-engine are set, for instance, after the output of TDC pulse and after the rotation of the crank shaft by 90 degrees from the output of TDC pulse.

In the inner face of the cylinder 1, exhaust valves 3A and 3B are opened and closed by pistons 2A and 2B that are installed in the cylinder 1 to be able to slide on the inside of the cylinder 1. Control valves 4A and 4B are provided in the upper section of an exhaust port for the control of the opening and closing times for the exhaust port 3A and 3B. An exhaust pipe 5 connected to the exhaust port 3A consists of the first pipe section 5A which expands the diameter of its downstream side end and second pipe section 5*b* of a conical truncated shape which is connected to the downstream side end of the first pipe section 5*a*. An expansion chamber 6 is provided in the downstream side end of the first pipe section 5*a* and inside of the second pipe section 5*b*. A connecting pipe 23 joins the small diameter end, namely, the downstream side end of the secondary pipe section 5*b* in the exhaust pipe 5 and is affixed thereto. The outer end of the connecting pipe 23 is connected to a muffler 8. In the second pipe section 5*b*, a conical truncated reflection pipe 24 is provided as a control device to reflect positive pressure waves generated by exhaust gas towards the exhaust port 3A. This reflection pipe 24 is installed in the second pipe section 5*b* with the large diameter end of the pipe 24 to the side of the first pipe section 5*a*. A collar (not shown) is disposed on the small diameter end of the reflection pipe 24 and is slidably positioned on the outer circumference of the connecting pipe 23.

A servomotor 26 is provided as a drive source which is connected to the reflection pipe 24 through a power transmission mechanism 27. The action of the servomotor is controlled by an electronic control device 20. More specifically, within the second pipe section 5*b*, a drive shaft 29 is rotatably supported on a bearing section that is provided on the outer face of the upper section of the large diameter. This drive shaft 29 and a driven shaft 30, installed at the large diameter end of the reflection pipe 24, are connected by a connecting rod 31, and the power transmission mechanism 27 is connected to the drive shaft 29.

With the above described constitution, the connecting rod 31 swings and the reflection pipe 24 slides along the connecting pipe 23 by the swinging motion of the connecting rod 31 as the drive shaft is driven. The servomotor 26 is provided with a potentiometer 34. The position of the refection pipe 24, that is the rotational amount of the drive shaft 29 is detected by this potentiometer 34 and a detected amount Θt is inputted to an electronic control device 20 through an analog-digital (A/D) converter 60.

The reflection pipe 24 is provided in the exhaust pipe (not shown) connected to the exhaust port 3B and may be driven by the servo motor 26 or another servomotor.

The control valves 4A and 4B provided in the above-mentioned exhaust ports 3A and 3B are fixed to drive shafts 12A and 12B that are rotatably mounted in the cylinder 1. The above-mentioned drive shaft 12A is connected to a servomotor 14 as a drive source through a power transmission mechanism 13 which consists of a pulley, drive belt, etc. The servomotor 14 is provided with a potentiometer 15 for detecting the amount of work of the servomotor 14, namely the degree of opening of a control valve 4A. A detected value Θr of the potentiometer 15 is inputted to the electronic controller 20 through the A/D converter. The drive shaft 12B may be actuated by the servomotor 14 or another servomotor.

An injector 52 is provided in the intake passage connected to the F bank 1F on the downstream side of the air flow through the throttle valve 58 of the above-mentioned two cycle engine.

An injector similar to the above-mentioned injector 52 is provided in the intake passage connected to the F bank IF on the downstream side of the air flow through the throttle valve 58.

The above-mentioned injector 52 is positioned to inject fuel towards an engine oil (hereinafter called simply, oil) supply port 77, that opens to the downstream side of the throttle valve 58.

This injector 52 is connected to a fuel tank 56 via a fuel pump 54, and the time of fuel injection, electric current passage time, of the injection is controlled by an electronic control device 20. Further, at the above oil supply port 77, the oil for lubrication is supplied from an oil tank 75 by the operation of an oil pump 76.

As a result of providing the injector 52 as described above, the oil injected from the oil supply port 77 is washed by the injected fuel so that the oil can be supplied efficiently into the crankcase through a reed valve.

The fuel-air mixture supplied into the crankcase is pre-pressurized by the descending piston and supplied into the combustion chamber through scavenging channels 96A and 96B.

The throttle valve 58 is provided with a potentiometer 59 to detect the opening, Θth of said throttle valve. The detected opening Θth is also inputted to the electronic control device 20 through the A/D converter 60.

The crank shaft 61 of the above-mentioned two cycle engine is formed with a plurality of pawls 62. The pawls 62 are detected by a first pulser PC1 and second pulser PC2. Output signals of the first and second pulses, PC1 and PC2, are inputted to the electronic control device 20.

Further, an indicated pressure sensor 72 is installed for detecting the pressure PI in the combustion chamber, hereinafter called indicated pressure. As will be explained with reference to FIG. 4, the pressure sensor 72 is positioned at the head section of a stud bolt 98. The indicated pressure sensor 72, cooling water temperature sensor 73 for detecting the temperature, $T_W$ of the engine cooling water, negative pressure sensor 74 for detecting negative pressure PB, atmospheric pressure sensor 78 for detecting the atmospheric pressure $P_A$, and atmospheric temperature sensor 80 for detecting the atmospheric temperature $T_a$ are also connected to the electronic control device 20 through the A/D converter 60.

The electronic control device 20 is provided with a micro-computer which includes a CPU, ROM, RAM, input and output interfaces, and bus lines for connecting the elements together, etc. The electronic control device 20 controls not only the timing and time of electric current supply to the injector, but also the ignition of the ignition plugs, the openings of the control valves 4A and 4B, and the position of the reflection pipe.

In addition, an air cleaner 57 and a battery 59 are also provided. The arrow b shows the direction of rotation of the crank shaft, and the arrows a and c show the direction of the flow of the fuel-air mixture.

Figure 3:
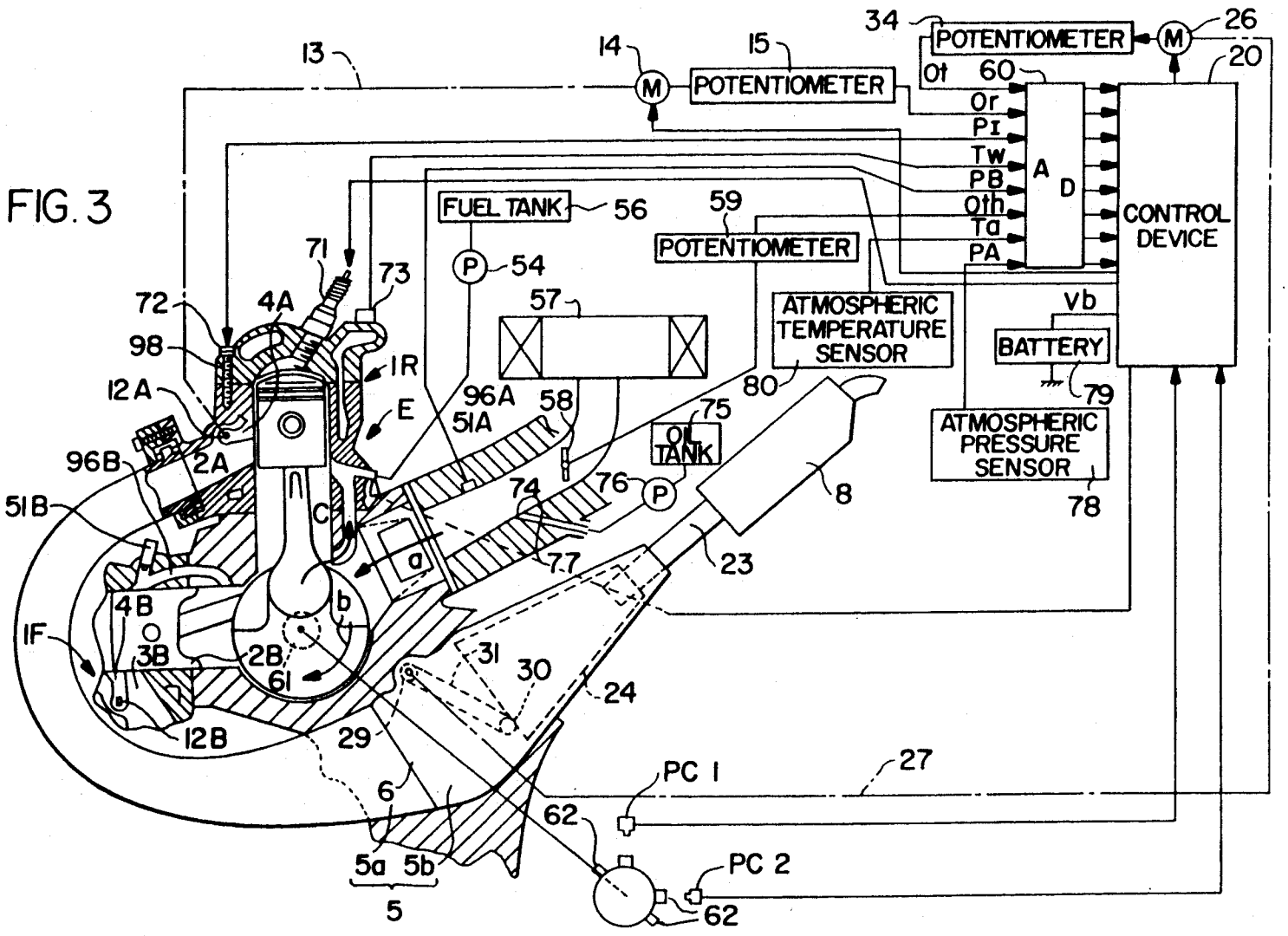
FIG. 3 is a schematic diagram of another embodiment of the invention.

FIG. 3 is schematic diagram of another embodiment of the invention, and the numerals which are used in FIG. 1 represent the same or equivalent parts in FIG. 3.

The embodiment in FIG. 3 is characterized in positioning an injector 51A for the R bank 1R and an injector 51B for the F bank 1F at the positions where they can respectively aim at the exhaust ports of respective scavenging passages 96A and 96B.

Figure 4:
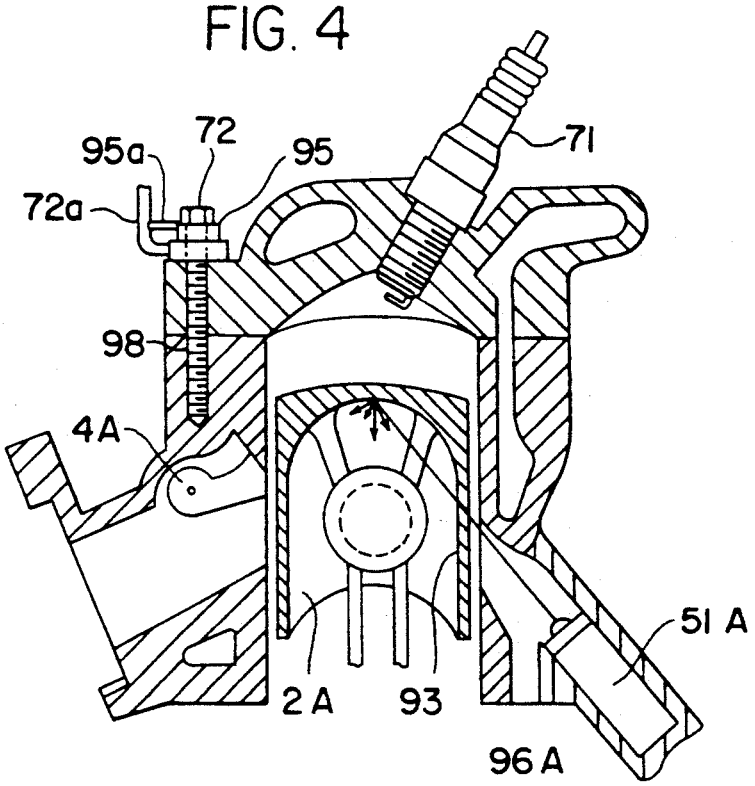

FIG. 4 is a partial enlargement of the R bank 1R and the numerals used in FIG. 3 representing the same or equivalent parts are also used in FIG. 4. The F bank 1F used according to the present invention has the same construction as the R bank 1R.

In FIG. 4, an injector 51A is installed in the scavenging passage 96A in the direction in which the injector 51A injects fuel directly to the rear face of the head section of the piston 2A. The timing of the fuel injection is such that fuel is directly injected to the rear face of the head section of the piston 2A through the hole 93 provided at the skirt section of the piston 2A.

The fuel atomized by injection is once supplied to the crank case and then it is supplied to the combustion chamber through the scavenging passage A.

With the construction identified above explained, the atomization of the fuel is excellent with improved mechanical efficiency, and at the same time the piston 2A is cooled by the fuel with better cooling capability. Furthermore, since the fuel in the state of atomization is once supplied to the crank case, it is possible to use the atomized fuel as a lubricant as well.

An indicated pressure sensor 72 and a washer 95 are connected in series to the stud bolt 98. A lead wire 72*a* of the indicated pressure sensor 72 is supported by the pawl 95*a* of the washer 95.

With this construction it is possible to conduct simple maintenance of the plug 71 in comparison with the arrangement of installation as before wherein the indicated pressure sensor 72 was connected in series with the plug 71. Furthermore, since there is no need to remove the indicated pressure sensor during plug replacement, it is possible to protect the sensor and maintain accuracy in the output of the sensor.

Figure 5A:
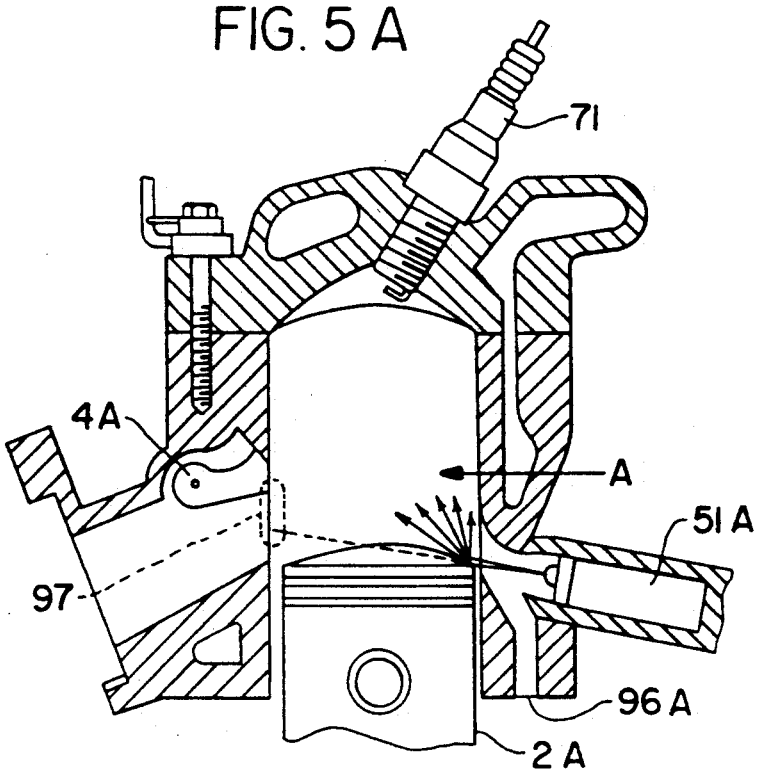

FIG. 5A shows another method of installing the injector 51A. In FIG. 5A the same numerals which are used in the above description represent the same or equivalent parts. In addition, FIG. 5B is a plan view of the inside of the cylinder which is viewed from the direction of the arrow A in FIG. 5A. A valve face 99 of the control valve 4A and a target 97 for fuel injection are provided. The target position 97 is substantially at the center of the exhaust gas opening of the exhaust gas port 3A.

In the embodiment, the injector 51A, is placed at the position from which the exhaust gas port of the scavenging passage 96A can be aimed at and in the direction in which the fuel is directly injected to the target position 97. The timing of the fuel injection is such as to directly inject the fuel towards the head section of the piston 2A.

With this construction the atomization of the fuel is excellent, and, furthermore, the fuel is injected upwards with improved combustion efficiency.

Next, the operation of one embodiment of the invention will be explained. At first Ne pulse and cylinder pulse, or TDC pulse, hereinafter called CYL pulse, which is required in the explanation of the operation of the embodiment will be explained.

FIG. 6A is explains the Ne pulse and CYL pulse, and FIG. 6B is a schematic view of the pawl 62 which is installed concentrically with the crank shaft 61, first pulser PC1 and second pulser PC2. FIG. 6B is a timing chart of the pulses outputted from the first pulser PC1 and second pulser PC2 when the crank shaft 61 is rotated in the direction of the arrow b of FIG. 6A for the Ne pulse and CYL pulse.

As is apparent from FIG. 6, the Ne pulse and CYL pulse are an OR signal and AND signal of the pulses outputted from the first pulser PC1 and second pulser PC2.

Here, as shown in detail in FIG. 7 the pulse outputted from the first pulser PC1 and pulse outputted from second pulser PC2 have some time delay between them so that Ne pulse which is an OR signal is outputted earlier than the CYL pulse which is an AND signal.

Every time the Ne pulse is outputted, a stage counter is incremented, and the count value is reset every time the CYL pulse is outputted or every time a specified number of Ne pulses are outputted after the output of CYL pulse. Namely, in this example, the number of stages, stage number, is 0–6. Next, the crank interrupt processing by Ne pulse in the embodiment will be explained.

Figure 8:
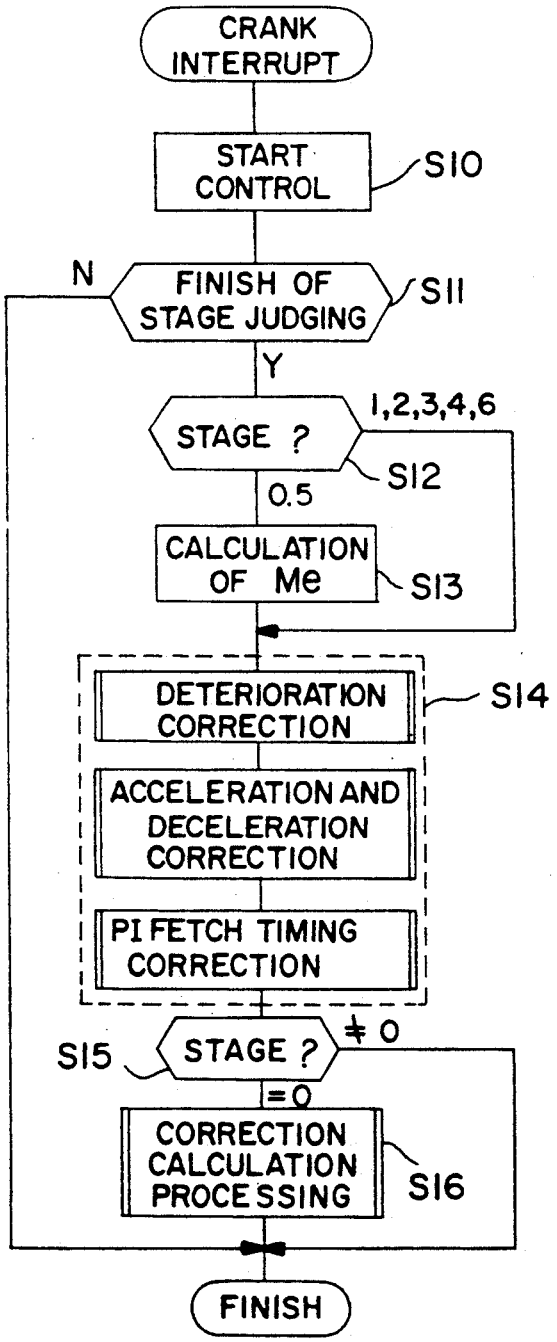
FIG. 8 is a flow chart of crank interrupt by Ne pulse.

FIG. 8 is the flow chart of crank interrupt routine. After the ignition is switched on, the conditions of the engine, that is, various engine parameters, atmospheric temperature Ta, cooling water temperature Tw, atmospheric pressure Pa, negative pressure PB, throttle opening Θth, battery voltage Vb, etc., are inputted and the series of initial processings are finished. Then the crank interrupt, TDC interrupt and other interrupts are permitted.

If a crank signal is detected after the interrupt permission, various starting controls are made in step S10 and in step S11, it is determined whether or not stage judging is finished. In step S12 1F stage judging is made, and if "0" or "5", the reciprocal, Me of rotational speed of the engine Ne is calculated and the step proceeds to step S14. If stage is other than "0", "5", the step proceeds to step S14.

However, if Ne is high, the step proceeds to step S14 only when TDC is 360°, 720° and 1440° in response to Ne, and if TDC is otherwise, the present processing is finished.

In step S14, processings to regulate the basic fuel injection quantity Ti deterioration correction, acceleration reducing correction, and PI fetch timing correction processings are made to set up a basic fuel injection quantity.

In the following, the deterioration correction processing, acceleration reducing correction, and PI interrupt timing correction processings will be explained.

(1) Deterioration correction processing

The deterioration correction attempts to regulate the injected fuel quantity based on the difference of the absolute values of a target negative pressure PB and an actual negative pressure PB during engine idling, in order to cope with the change in the most suitable injected fuel quantity after years of operation.

For instance, if the intake air amount of an engine decrease with years of operation, the air-to-fuel ratio becomes rich and if the friction is reduced in break-in running and the output is raised, the intake is increased and the air-to-fuel ratio becomes thin.

Now, a target negative pressure PB and actual negative pressure under specified conditions are compared, and if the absolute value of the actual negative pressure PB is small, the fuel injection quantity reducing correction is made, and if it is larger, the fuel injection quantity increasing correction is made.

Figure 10:
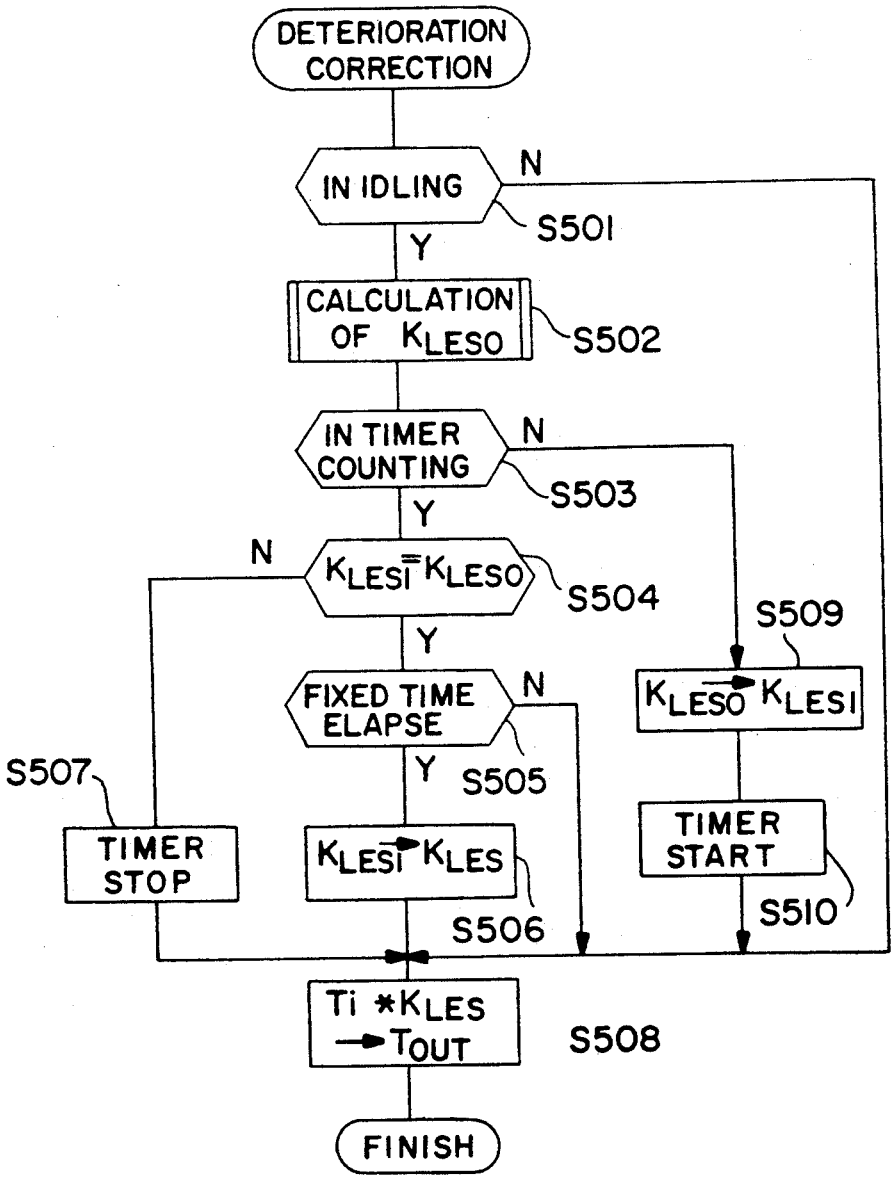
FIG. 10 is a flow chart of engine deterioration correction.

FIG. 10 shows the flow chart of the deterioration correction processing. In step S501, it is judged whether the engine is idling based on the engine's rotational speed Ne and the opening Θth of the throttle valve. If not in idling, the step proceeds to step S508.

Figure 29:
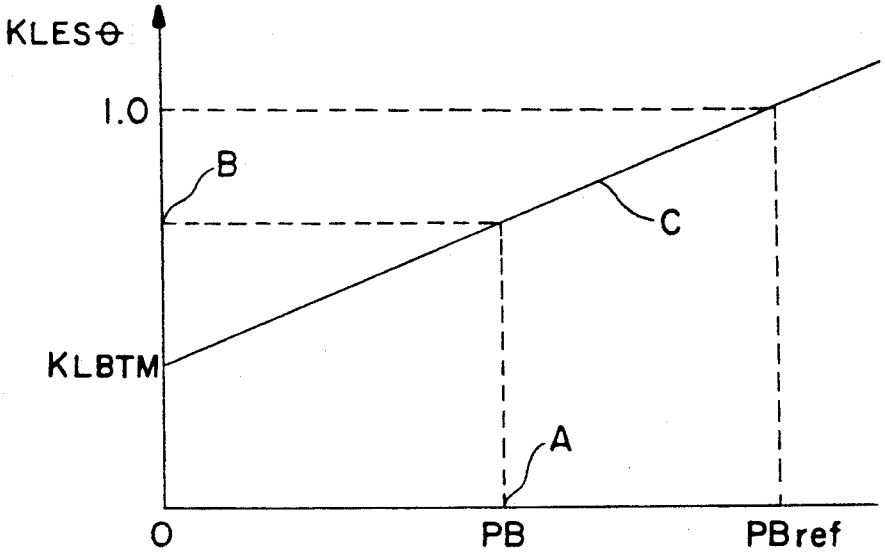
FIG. 29 is a graph to show the method of calculating deterioration correction coefficient, $K_{LESO}$.

If the engine is idling, a deterioration correction coefficient $K_{LESO}$ is calculated in step S502. The method to calculate the deterioration correction coefficient $K_{LESO}$ will be explained with reference to FIG. 29. In FIG. 29 the negative pressures are represented on the abscissa and the correction coefficients $K_{LESO}$ on the ordinate.

Firstly, an ideal negative pressure $PB_{ref}$ at the time of stable ignition corresponding to the opening Θth of the throttle is retrieved from the data table. Next, a point where $K_{LESO}=1.0$ for $PB_{ref}$ is set, and at the same time the specified value $K_{LBTM}$ for PB=0 is set. A straight line C passing through those two points is determined, and on this line C a point, point shown by B, on $K_{LESO}$ axis which corresponds to the negative pressure PB at present, point shown by A in FIG. 29, is calculated by interpolation on the line. The value of the point B is the value of $K_{LESO}$ to be calculated.

In step S503, the period in which the coefficients $K_{LESO}$ calculated according to the negative pressure at present are the same value, in other words, it is judged whether or not a renewed judging timer to measure the period of the same value of the negative pressure PB is counting, and when it is not counting, the coefficient $K_{LES1}$ is set to $K_{LESO}$ in step S509, and after the timer is started in step S510, the step proceeds to step S508.

On the other hand when the timer is counting, the coefficients $K_{LES1}$ and $K_{LESO}$ are compared in step S504, and when they do not match, the timer is stopped in step S507 and the step proceeds to step S508.

If both match, it is judged that deterioration has probably occurred and in step S505 reference is made to the renewed judging timer. In step S505 it is judged whether or not a certain time has passed, in other words whether or not the coefficient $K_{LESO}$, calculated in the above-mentioned step S502, has been the same for a planned period. If a certain time has passed, the coefficient $K_{LES1}$ is set to $K_{LES}$ and the coefficient $K_{LES}$ is renewed in step S506, and the step proceeds to step S508.

In step S508 the basic fuel injection quantity Ti is multiplied by $K_{LES}$ and the result is registered as a new injection quantity $T_{OUT}$.

With the deterioration correction processing as described above, the most suitable fuel injection quantity can be obtained from the initial stage of engine operation through break-in running and further to the operation after the temporal deterioration, and the most suitable air-to-fuel ratio is thereby always provided.

(2) Acceleration reducing correction

Acceleration reducing correction is the reducing correction to be applied to the fuel injection quantity in order to eliminate the condition that desirable acceleration is not achieved because of the richness in the air-to-fuel ratio caused by the insufficient increase in the volume of sucked air in proportion to the opening Θth of the throttle at the time of acceleration. The acceleration reducing correction reduces temporarily the fuel injection quantity which is increased in response to the opening Θth to maintain always the most suitable air-to-fuel ratio.

The acceleration reducing correction will be explained in detail in reference to FIG. 11 through FIG. 15.

Figure 11:
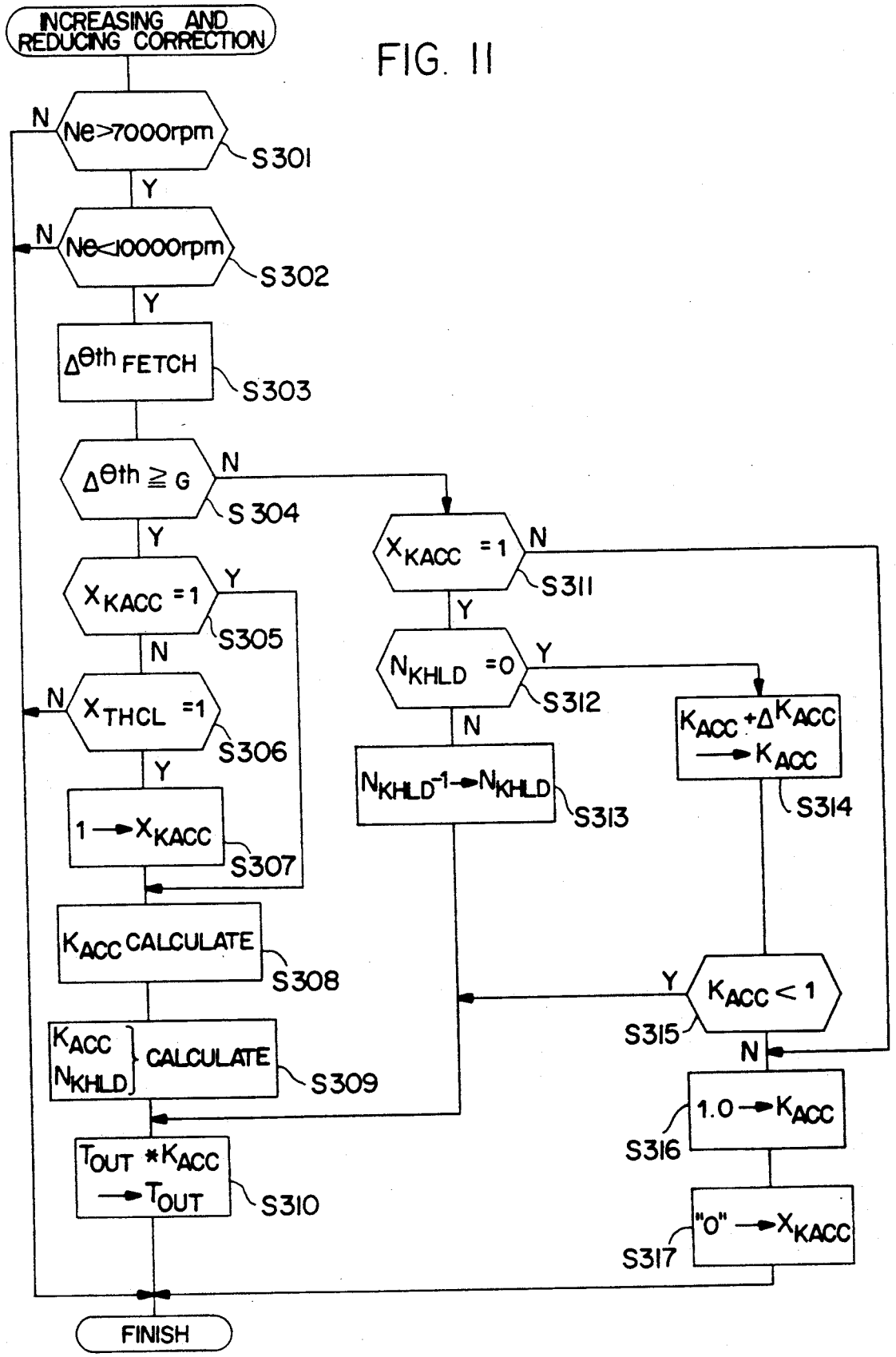
FIG. 11 is a flow chart of acceleration reducing correction.

FIG. 11 is a flow chart of an acceleration reducing correction. In step S301 the engine rotational speed Ne is over 7,000 rpm. Further, in step S302 the speed Ne is less than 10,000 rpm. Then in step S303, the differential ΔΘth of the opening Θth of the throttle is fetched.

On the other hand, if the rotation, Ne is below 7,000 rpm or over 10,000 rpm, the processing is finished. In step S304 the differential ΔΘth of the opening of the throttle is compared with a specified value G, for instance, 5%/4 ms, and if ΔΘth=G, it is judged that the engine is in acceleration, and the step proceeds to step S305, and if ΔΘth<G, the step proceeds to step S311.

In step S305, the flag $X_{KACC}$ for acceleration correction to determine whether or not acceleration is in a correction mode is shown and checked. If it is being corrected ($X_{KACC}=1$), the step proceeds to step S308, and if it is not ($X_{KACC}=0$), step proceeds to step S306.

In the step S306, the acceleration initial flag $X_{THCL}$ to show whether or not the acceleration is in the beginning is checked, and if it is ($X_{THCL}=1$) the step proceeds to step S307, and if it is not ($X_{THCL}=0$), the processing is finished.

Here, the processing of the setting of acceleration initial flag $X_{THCL}$ that is carried out as a pre-processing for the acceleration reducing correction will be explained by using the flow chart in FIG. 12. In step S3061 the state of initial flag $X_{THCL}$ is judged, and if $X_{THCL}=1$ and the opening Θth of the throttle is judged to be, for instance, 20% in S3062, the flag $X_{THCL}$ is reset in step S3063.

On the other hand, if it is judged that $X_{THCL}=0$ and the opening Θth of the throttle is below 5% in step S3064, the flag $X_{THCL}$ is reset in step S3065.

Meanwhile, even if $X_{THCL}=1$, when the opening Θth is less than 20%, and even if $X_{THCL}=0$, when the opening Θth of the throttle is over 5%, the present processing is finished as it is.

The results of setting the acceleration initial flag $X_{THCL}$ based on the opening Θth of the throttle are as shown in FIG. 13.

Returning to FIG. 11, in step S308 the coefficient of acceleration reducing correction, $K_{ACC}$ is calculated based on $K_{ACC}$/ Θth table. In the $K_{ACC}$/ Θth table, various values of $K_{ACC}$ which are calculated based on $K_{ACC}$ with the opening Θth of the throttle as shown in FIG. 14 as parameter, are registered.

In the present embodiment of the invention the coefficients of acceleration reducing correction, $K_{ACC}$ are registered at four points, that is, Θth=10%, 20%, 30%, 40% with the opening Θth of the throttle as a parameter. If Θth does not correspond to the points in an actual case, the most suitable value is calculated by interpolation based on the four points. The coefficients $K_{ACC}$ can be registered or calculated with the engine's rotational speed Ne as a parameter.

In step S309 $K_{ACC}$ and a set value $N_{KHLD}$ for the correction hold counter are retrieved based on the data table. Here, $K_{KHLD}$ is the timer to measure the period in which the judgement is made, that it is still in the initial acceleration even after Θth has become a value smaller than a specified value (G), and $K_{ACC}$ is the coefficient that is added to the coefficient $K_{ACC}$ in order to increase gradually the quantity of injected fuel $T_{OUT}$ after the above-mentioned period is finished.

Figures 14, 15A, 15B:
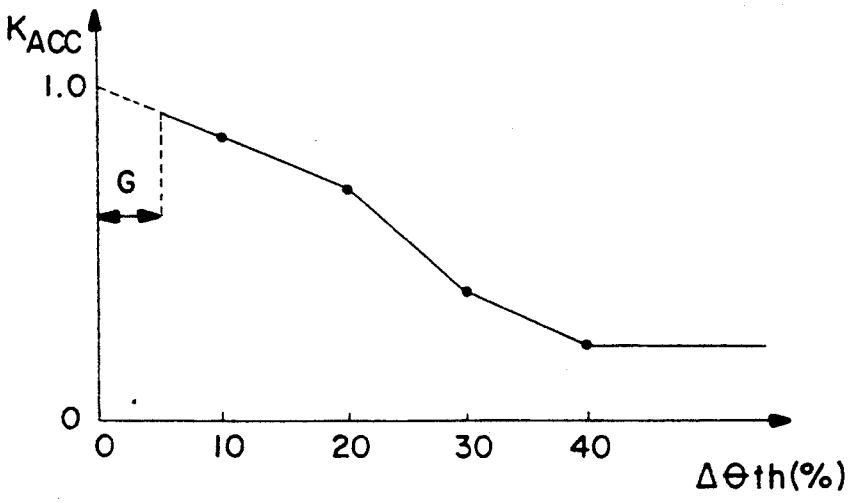
FIG. 14 is a graph to show the relation between the acceleration reducing correction coefficient, $K_{ACC}$ and the opening Θth of the throttle.
FIGS. 15A and 15B are a table to show the relation between the correction coefficients and rotational speeds Ne.

In this data table for correction hold counter $N_{KHLD}$ and $\Delta K_{ACC}$ which will be explained below three kinds of values (N1, N2, N3) and ( ΔK1, ΔK2, ΔK3) are respectively prepared with the engine's rotational speed Ne as parameter as shown in FIG. 15A, and the most suitable value is retrieved according to the engine's rotational speed Ne.

Meanwhile, in the above explanation. $K_{ACC}$ and $\Delta K_{ACC}$ and $N_{KHLD}$ are calculated and retrieved separately, but if a data table as shown in FIG. 15B is set, the above-mentioned step S309 and step S308 can be merged.

In step S310 fuel injection quantity, $T_{OUT}$ is multiplied by the coefficient $K_{ACC}$ to set a new fuel injection quantity $T_{OUT}$. On the other hand in the above-mentioned step S304, if ΔΘth<G is judged, the flag $X_{ACC}$ for acceleration reducing correction is checked in step S311, and if the correction is being made ($X_{ACC}=1$), the step proceeds to step S312, and if it is not, the step jumps to S316.

In step S312 the correction hold counter $N_{KHLD}$ is checked, and if $N_{KHLD}=0$ does not hold, $N_{KHLD}$ is incremented by 1 in step S313 and then the step proceeds to seep S310.

Further, if $N_{KHLD}=0$, $\Delta K_{ACC}$, is added to the coefficient $K_{ACC}$ of acceleration reducing correction in step S314 to set a new coefficient, $K_{ACC}$ of acceleration reducing correction.

In step S315 the upper limit of the coefficient $K_{ACC}$ is checked. If $K_{ACC}<1$, the step proceeds to step S310, and if $K_{ACC}\geqq=1$, 1.0 is set to $K_{ACC}$ in step S316, and in step S317 the flag $X_{KACC}$ for acceleration reducing correction is reset and the present processing is finished.

With such acceleration reducing correction, the fuel injection quantity is reduced temporarily during acceleration so that an excellent acceleration characteristic can be provided.

(3) PI fetch timing correction

PI fetch timing correction is to correct PI fetch timing according to engine's rotational speed Ne so as to make accurate misfire judging.

Figure 16A:
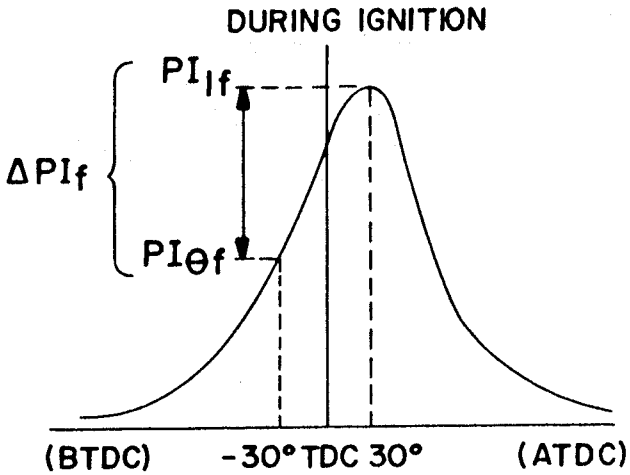
FIGS. 16A, 16B, 17A and 17B show the timings of fetching indicated pressure PI.
Figure 16B:
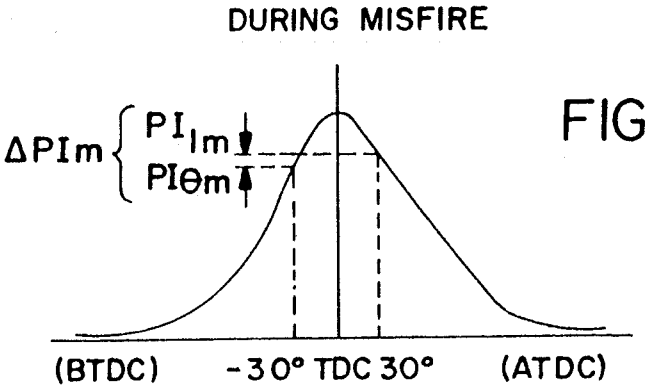

At first the method to judge misfire by the indicated pressure PI will be explained briefly. FIGS. 16A and 16B show the indicated pressure PI before TDC and after TDC. FIG. 16A shows the conditions at the time of ignition and FIG. 16B at the time of misfire.

It is obvious from the comparison of FIG. 16A and FIG. 16B that at the time of ignition the indicated pressure PI shows a high value after a little time from TDC and at the time of misfire the indicated pressure PI shows a high value after a little time from TDC and at the time of misfire the indicated pressure PI shows its peak value only near TDC.

Now, in the prior art the fetch timing of indicated pressure PI is set at two angles, for instance, at −30°, and +30°, fixed in the range of 45° on both sides with TDC at the center. Based on the fact that the difference $\Delta PI_f$ between the indicated pressure $PI_{fo}$ before TDC at the time of ignition and the indicated pressure $PI_{fi}$ after TDC at each timing is much larger than the difference $\Delta PI_m$ between the indicated pressure $PI_{mo}$ before TDC and $PI_{mi}$ after TDC at the time of misfire, ignition was judged if the difference between $PI_o$ and $PI_i$ was larger than a specified value and misfire was judged if it was lower.

However, especially with two cycle engines, the ignition timing is delayed and the temperature in the exhaust pipe is raised in order to obtain a high power output by utilizing effectively the pulsation effect in the exhaust gas when the engine is in the range of high rotation.

Figure 17A:
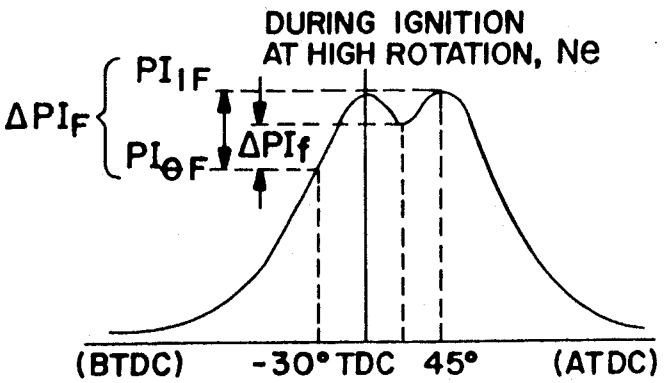
Figure 17B:
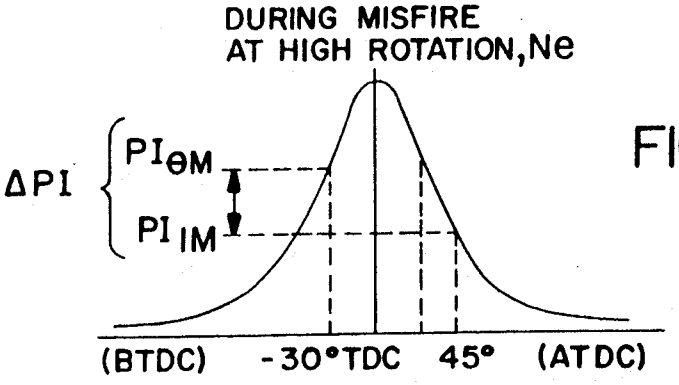

FIG. 17A shows the indicated pressure at the time of ignition and FIG. 17B shows the indicated pressure at the time of misfire when the ignition timing is delayed at a high rotation Ne of the engine.

It is obvious from FIGS. 17A and 17B that the indicated pressure, PI at the time of ignition shows peak value at TDC, and at the time of ignition thereafter if the ignition timing is delayed at a high engine's rotational speed, Ne. Between those peak values the indicated pressure drops once.

Accordingly, if the fetch timing is fixed at $30_o$ in spite of the delay of the ignition timing, the detected indicated pressure difference, $\Delta PI_f$ becomes small and the misfire judging becomes difficult.

In the present embodiment the fetch timing is delayed, for instance at 45°, according to the engine's rotational speed, Ne. With this delay the difference $\Delta PI_f$ between the indicated pressure $PI_{mo}$ before TDC and the indicated pressure $PI_{mi}$ after TDC at the time of misfire, makes the judging of misfire easy.

In the following the method of judging misfire based on the difference ΔPI between $PI_o$ and $PI_i$ of this embodiment will be explained with reference to FIG. 30.

Figure 30:
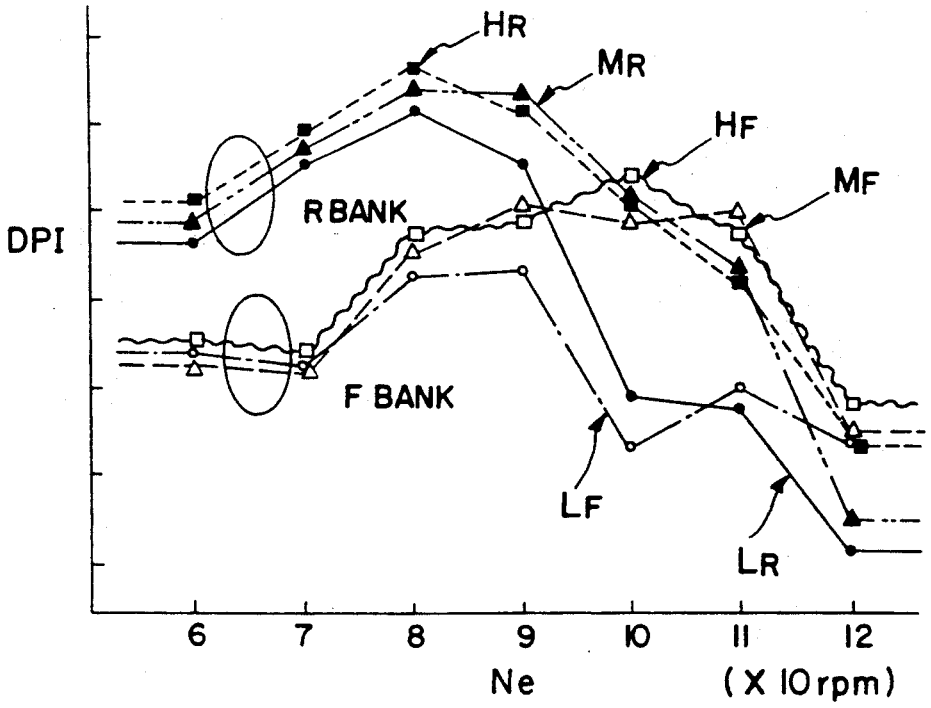
FIG. 30 is a graph to explain the method of judging misfire by the indicated pressure PI.

In FIG. 30 the misfire judgement standard value, DPI is set respectively for the F bank and for the R bank based on the engine's rotational speed Ne and the opening Θth, each a broken line, of the throttle valve.

The opening, Θth of the throttle valve is divided in a plurality of areas by three standard values, THL, THM, THH (THL<THM<THH), and if THL≦Θth≦THM, reference is made to the broken line LF (LR), and if THM≦Θth≦THH, reference is made to the broken line MR (MF), and if THH≦Θth, reference is made to broken line HF (HR). If Θth<THL, misfire is not judged.

The judgement of misfire is made by comparing the misfire judging standard value, DPI that is given based on the engine's rotational speed, Ne and the opening, Θth of the throttle valve, and the above-mentioned PI, and if DPI≦ΔPI, ignition is judged and if DPI>PI, misfire is judged.

Next, PI fetch timing correction will be explained in detail with reference to FIG. 18. In step S400 it is determined if priority processing exists, and if there is, the present processing proceeds to step S408 and if there is not, it proceeds to S401.

The term priority processing here means the processing when any one of the flags $XPI_{FIGET}$, $XPI_{ROGET}$, $XPI_{RIGET}$, and $XPI_{FOGET}$ is set. The flags will be explained below.

In the flags above-mentioned, each represents the timing of the indicated pressure which is to be next detected. For instance, if $XPI_{FIGET}$ is set, it means that the indicated pressure $PI_{FI}$ after TDC (ATDCO) of F bank 1F is detected, and if $XPI_{ROGET}$ is set, it means that the indicate pressure $PI_{RO}$ before TDC (BTDC) of R bank 1R is detected.

In step S401 stage judging is made, and following processings are executed according to the stage number.

(1) Stage=0:

In step S402 the negative pressure of the front bank, $PB_F$ is read, and in step S403 the processing is finished after setting flag $XPI_{FIGET}$.

(2) Stage=1,2,3:

The present processing is finished.

(3) Stage=4:

In step S404 the present processing is finished after setting flag $XPI_{ROGET}$.

(4) Stage=5:

In step S405 the rear bank negative pressure $PB_R$ is read and in step S406 after flag $XPI_{RIGET}$ is set, the present processing is finished.

(5) Stage=6:

In step S407 after flag $XPI_{FOGET}$ is set, the present processing is finished.

On the other hand, in steps S408 through S411 the above-mentioned flags, $XPI_{FIGET}$, $XPI_{ROGET}$, $XXPI_{RIGET}$, and $XPI_{FOGET}$ are respectively judged.

According to the state of each flag, $TMP1_{FI}$ is set in step S412, $TMI_{FO}$ is set in step S413, $TMPI_{RI}$ is set in step S414, and $TMPI_{RO}$ is set in step S415 as count value to show fetch timing of indicated pressure PI to counter $N_{PI}$.

By the way, the above-mentioned count value is the value set in "PI correction coefficient processing" which will be explained below regarding FIG. 22, and it changes according to engine's rotational speed and delay angle of the ignition timing.

When a value according to the state of each flag is set in the timer as explained above, the count-down of the time is started in step S416.

In the following timer interrupt processing, in which a timer is processed for interrupt with priority when it is 0, will be explained with reference to FIG. 19.

The time when a timer is at "0" means that it is the indicated pressure PI fetch timing. In steps S421 through S424 the above-mentioned $XPI_{ROGET}$, $XPI_{RIGET}$, $XPI_{FOGET}$, and $XPI_{FIGET}$ and are judged and according to the state of each flag the detected indicated pressure PI is fetched as $PI_{FI}$ in step S425, and as $PI_{FO}$ in step S426, and $PI_{RI}$ in step S427, and as $PI_{RO}$ in step S427.

Namely, if the flag $XPI_{ROGET}$ is set, the indicated pressure PI which is fetched by the above-mentioned timing is registered as $PI_O$ of R bank 1R, if $XPI_{FIGET}$ is set, the indicated pressure PI which is fetched by the above-mentioned timing is registered as $PI_I$, in F bank 1F. In steps S429 through S432 each of the above-mentioned flags is reset.

It is possible, according to the PI fetch timing correction, to set the indicated pressure PI fetch timing arbitrarily by setting a specified value to timers, $TMPI_{FI}$, $TMPI_{FO}$, $TMPI_{RI}$, and $TMPI_{RO}$.

Returning to the crank interrupt processing in FIG. 8, in the step S15 stage judging is conducted, and the present processing is finished if the stage is not "0", and if stage is "0", the step proceeds to step S16.

Figure 9:
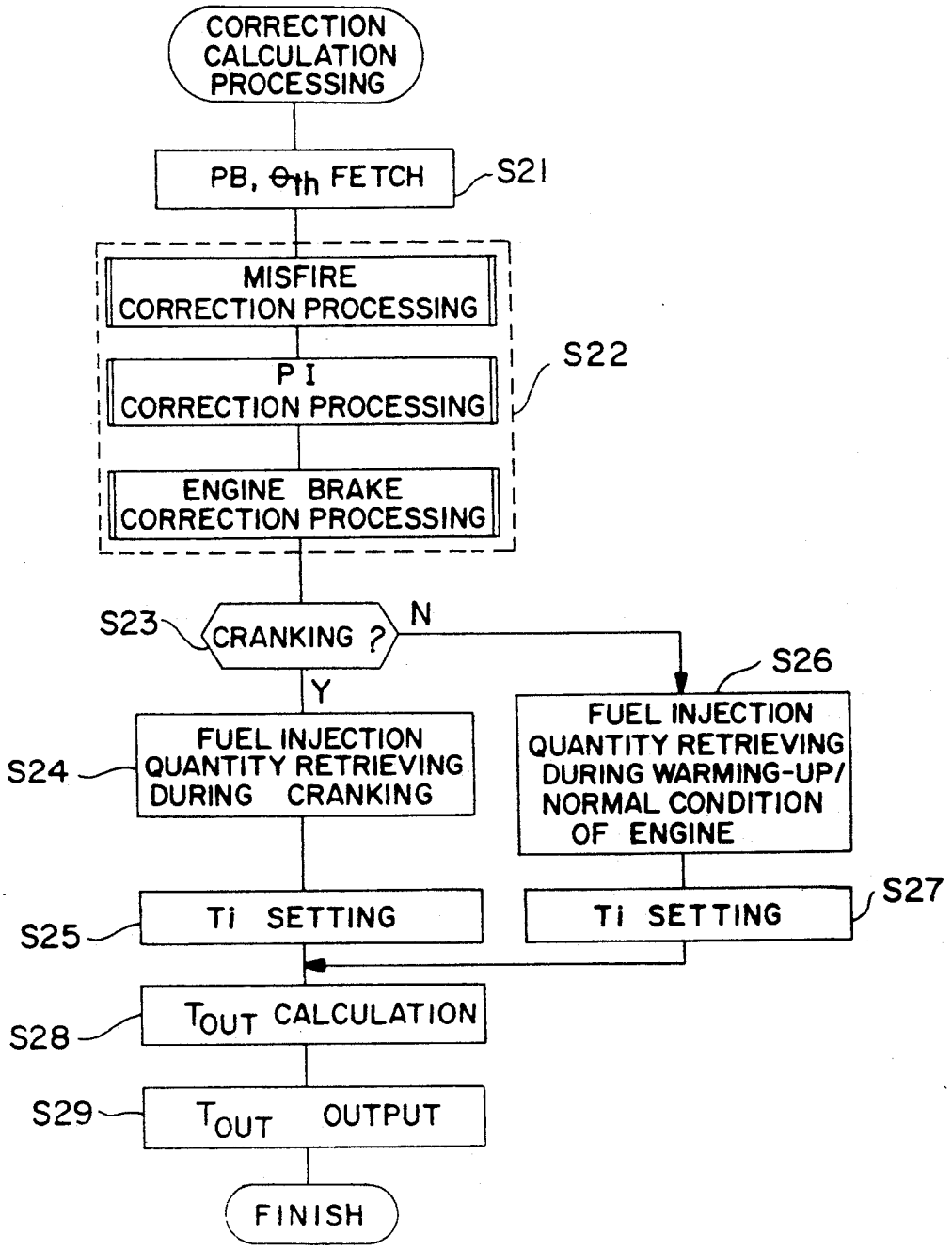
FIG. 9 is a flow chart of the correction calculation.

In the following the correction calculation processing in step S16 will be explained with reference to the flow chart in FIG. 9. In step S21 the negative pressure and the opening Θth of the throttle are read in, and in step S22 various correction processings for fuel injection quantity according to the atmospheric pressure, atmospheric temperature, water temperature, etc. and at the same time misfire correction proceeding, PI correction processing and engine break correction processing are executed.

(1) Misfire judging correction processing

Misfire judging correction processing means to detect the generation of misfire and reduce the fuel injection quantity.

Figure 20:
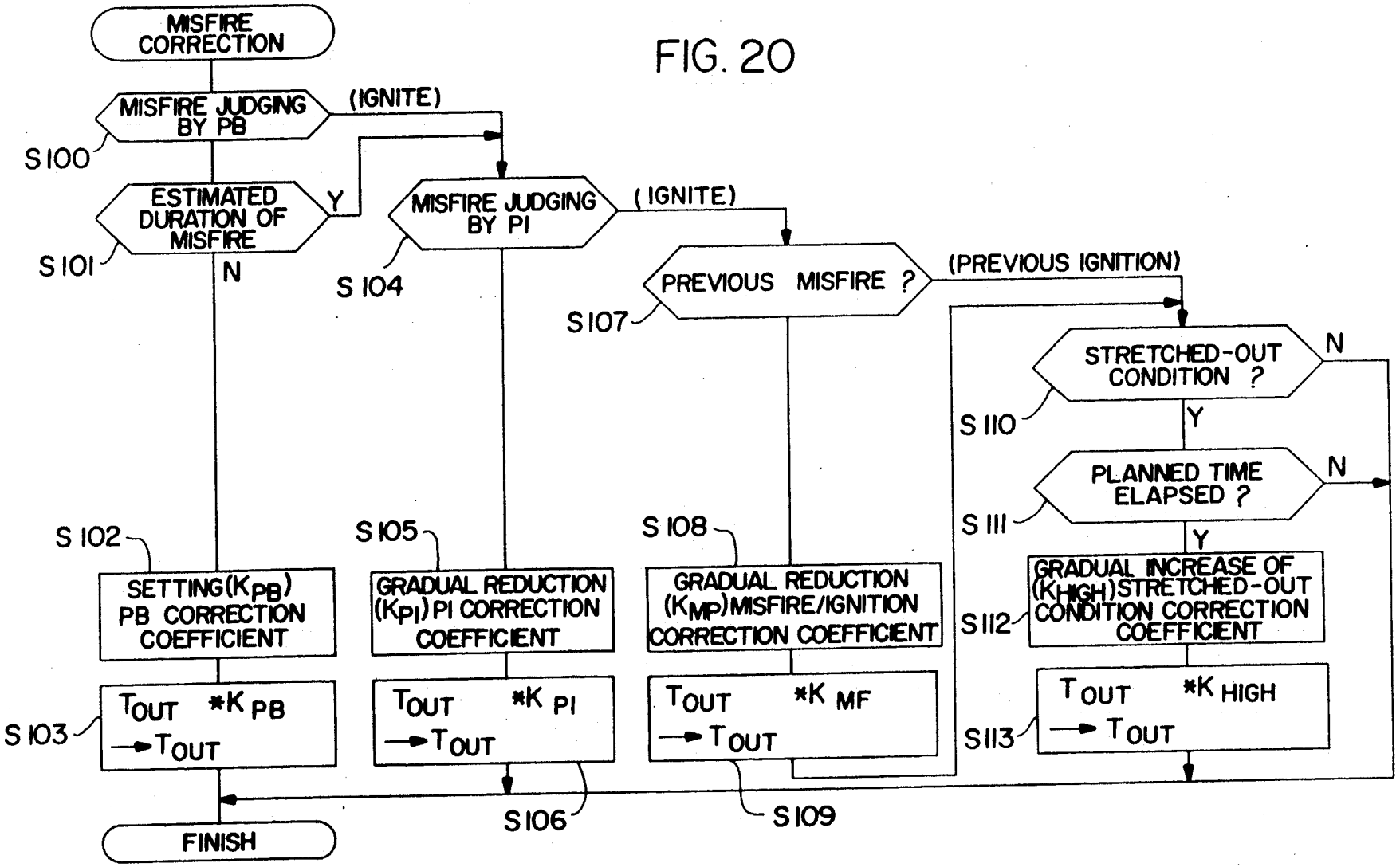
FIG. 20 is an approximate flow chart of the misfire correction.

FIG. 20 is an approximate flow chart of misfire judging correction processing and the content of the correction for misfire judging correction consists of the following four kinds of processing.

1. PB correction

PB correction refers to the calculation of a PB correction coefficient ($K_{PB}$; $K_{PB}=1$) when misfire is detected by the negative pressure which is detected by the above-mentioned pressure sensor 74 and to multiply the fuel injection quantity $T_{OUT}$ by the coefficient and reduce the fuel injection quantity.

2. PI correction

PI correction refers to the calculation of a PI correction coefficient ($K_{PI}$; $K_{PI}=1$) when misfire is detected by the indicated pressure PI which is detected by the above-mentioned indicated pressure sensor 72 and to multiply the fuel injection quantity $T_{OUT}$ by the coefficient and to reduce the fuel injection quantity gradually.

3. Misfire to ignition correction

Misfire to ignition correction refers to the counting of the number of times of condition change from misfire to ignition and to calculate misfire to ignition correction coefficient ($K_{MF}$ : $K_{MF}=1$) when the number of times of condition change from misfire to ignition is large and the possibility of misfire is large and to multiply the fuel injection quantity $T_{OUT}$ by the coefficient and reduce the fuel injection quantity gradually.

4. Stretched-out correction

Here stretched-out refers to the condition of the engine such as very high temperature in the exhaust pipe by, for instance, a large opening Θth of the throttle, over 90% for instance, and engine's rotational speed which is very high, over 12,000 rpm, for instance. When this stretched-out condition continues for a certain time, the exhaust gas temperature rises and the exhaust gas pulsation effect works well so that the air to fuel ratio becomes thin. Accordingly, when the stretched-out condition continues, the fuel injection quantity should be increased to make the fuel to air ratio thick.

In the embodiment of the invention described herein, when the engine's high rotational speed Ne and large opening Θth are kept over a certain time and a stretched-out condition is developed in which misfire is difficult to occur, the stretched-out coefficient (KHIGH; $K_{HIGH}=1$) is calculated and the fuel injection quantity $T_{OUT}$ is multiplied by the coefficient and the fuel injection quantity is increased gradually.

Figure 21A:
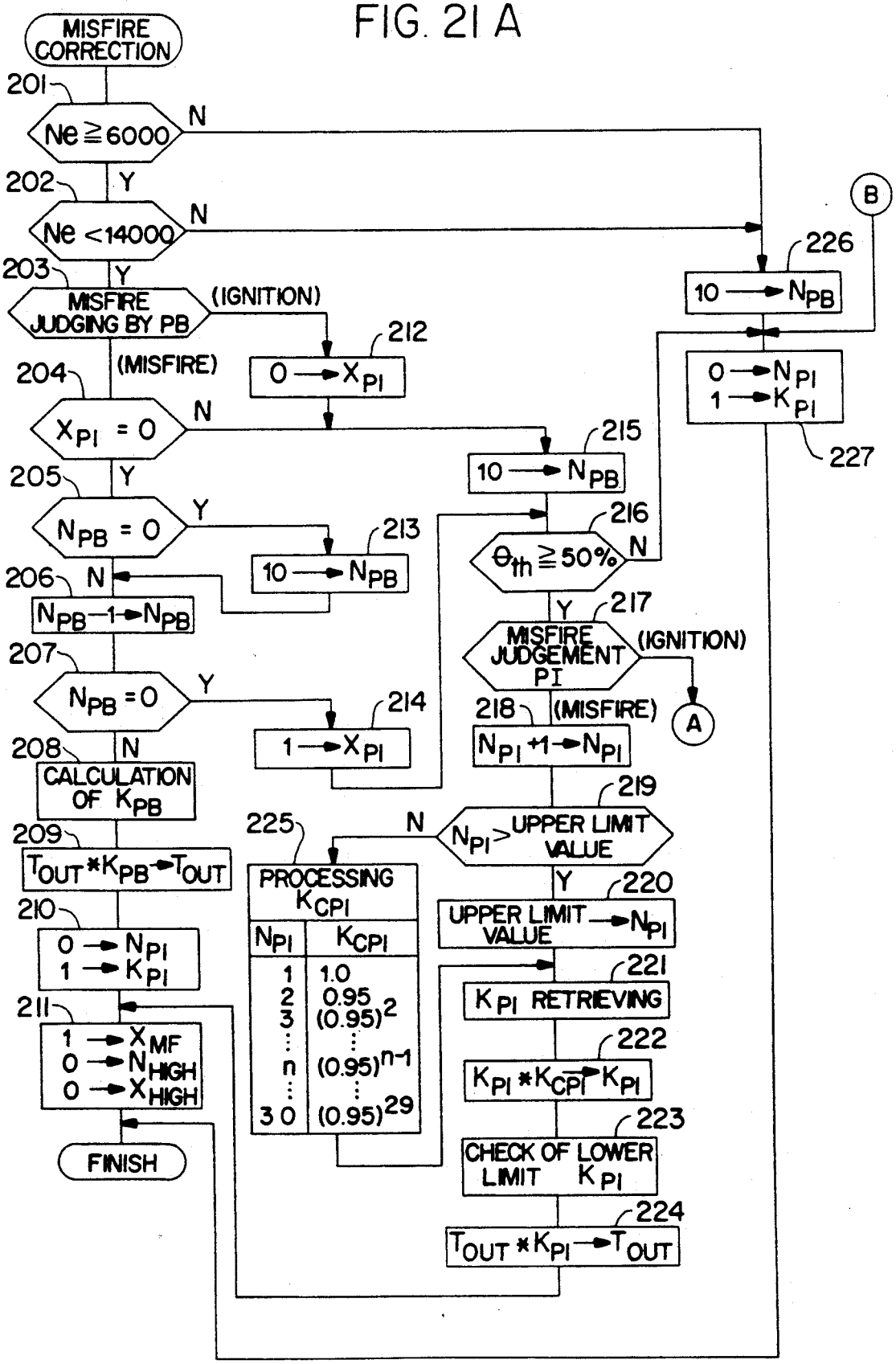

In the following, the outline of the correction will be explained with reference to the flow chart in FIG. 20. In addition, the flow chart of FIG. 21 and the content of the correction will be explained in detail.

In step S100 of FIG. 20, misfire judging is carried out based on the negative pressure PB detected by the negative pressure sensor, and when misfire is judged, it is judged in step S101 whether or not the state of misfire has continued for an estimated period which is beforehand expected. If the misfire has not continued for that period, PB correction coefficient ($K_{PB}$) is set in step S102, and in step S103 the fuel injection quantity $T_{OUT}$ is multiplied by the coefficient $K_{PB}$ to set the fuel injection quantity, $T_{OUT}$.

When the misfire judging based on the above-mentioned negative pressure PB continues for an estimated period or when misfire judging is made by the negative pressure, the present processing proceeds from step S101 to step S104, and misfire judging is made based on the indicated pressure.

In step S104 if misfire is judged, PI correction coefficient ($K_{PI}$) is set in step S105, and in step S106 the fuel injection quantity $T_{OUT}$ is multiplied by the coefficient, $K_{PI}$, and a new fuel injection quantity, $T_{OUT}$, is set.

The PI correction coefficient, $K_{PI}$ is renewed to be smaller gradually, every time the step S105 is carried out.

On the other hand, when the ignition is judged in step S104, the results of judging in step S104 or step S100 was ignition or not in the previous judging, is judged in step S107.

If the previous judging was misfire judging, misfire to ignition correction coefficient ($K_{MF}$) is set in step S108, and in step S109 the fuel injection quantity $T_{OUT}$ is multiplied by the coefficient $K_{MF}$, and a new fuel injection quantity $T_{OUT}$ is set.

Meanwhile, the coefficient $K_{MF}$ of misfire to ignition correction is renewed to be smaller every time the step S108 is carried out.

On the other hand, when misfire was judged in the previous judging in step S107, or when steps S108 and S109 are executed after the misfire judging in the previous judging, the present processing proceeds to step S110 and here the stretched-out condition is judged.

When the stretched-out condition is judged in step S110, it is judged in step S111 whether or not the condition has passed an estimated period, and if it has passed, a correction coefficient for the stretched-out condition, ($K_{HIGH}$) is set and in step S113 the fuel injection quantity is multiplied by the coefficient $K_{HIGH}$ and a new fuel injection quantity $T_{OUT}$ is set.

The coefficient $K_{HIGH}$ of stretched-out condition is renewed to be larger every time step S112 is carried out. Next, the misfire judging correction processing is further explained in detail with reference to the flow chart in FIG. 21.

When the misfire judging correction processing is carried out and the first engine's rotational speed is judged to be over 6,000 rpm in step S201 and further in step S202 the engine's rotational speed, Ne, is judged to be less than 14,000 rpm, the misfire judging based on the negative pressure PB is executed.

On the other hand, if the engine's rotational speed is less than 6,000 rpm or over 14,000 rpm, the probability of misfire is very low so there is no need for misfire judging correction. Accordingly, the present processing sets 10, for instance, to the counter $N_{PB}$ of the number of times of PB correction in step S226, and furthermore in step S227 the counter $N_{PI}$ of the number of times of PI correction is reset and after setting the coefficient $K_{PI}$ of PI correction the present processing is finished.

An outline of the method of judging misfire based on the negative pressure, PB in step S203 is as follows.

At first, the negative pressure, PB, hereinafter called target PB, in the intake pipe during ignition is retrieved from the target PB map with the engine's rotational speed, Ne and throttle opening Θth as parameters. In this target map various target PB values are set with Ne, Θth, and atmospheric pressure as targets.

When the target PB is retrieved, actual negative pressure is fetched, and from the difference PB) obtained by the actual PB deducted by the target PB, if PB is over a specified pressure (for instance, 7.5 mmHg) misfire is judged.

In the above-mentioned method of misfire judging, the target PB map has a three-dimensional construction with Ne, Θth and atmospheric pressure PA as parameter so that a large capacity of memory is required for the target PB map.

Now, in order to eliminate the atmospheric pressure PA from the parameter, the following method of misfire judging can be adopted. Namely, the target values at ignition, atmospheric pressure—PA—negative pressure PB, are beforehand registered with Ne and Θth as parameters, and when misfire is judged, $T_{PB}$ retrieved according to the Ne and Θth at that time, and a difference (PA−PB) between actually measured PA and PB are compared and the following judging is completed.

$$T_{PB}(PA-PB)=D_{PB};\ \text{ignition}$$

$$T_{PB}-PA-PB)=D_{PB};\ \text{misfire}$$

In the actual application, however, variation in the negative pressure, PB and the error in the detection sensors are taken in consideration and a specified thresh-level $D_{PB}$ (for instance, 7.5 mmHg) is set, and the following judging is completed.

$$T_{PB}-(PA-PB)\leqq 0\ ;\ \text{ignition}$$

$$T_{PB}-(PA-PB)>T_{TB};\ \text{misfire}$$

As the result of the above-mentioned judging, if misfire is judged in step S203, the PI correction flag X which shows that PI is being corrected is checked in step S204, and if $X_{PI}=0$, that is, PI is not being corrected, the step proceeds to step S205, and if $X_{PI}=1$, that is, PI is being corrected, the step proceeds to step S215.

In the present processing, as shown in step S101 of FIG. 20, the PB correction is repeated for an expected period even if misfire is not eliminated by the PB correction, the step proceeds to step S205 right after starting this processing.

In step S205, the value, $N_{PB}$ of counting by the counter of the number of times of PB correction, which represents the number of times of execution of PB correction, is checked, and if $N_{PB}=0$ does not hold, the count value is reduced by "1" in step S206, and if $N_{PB}=0$, after the count value "10" is set in step S213, the count value is reduced by "1" in the above-mentioned step S206.

In step S207 the counter $N_{PB}$ of the number of times the PB correction is checked again, and if $N_{PB}=0$ with PB correction carried out for a specified period, the flag $X_{PI}$ of PI correction is set in step S214 and the step proceeds to step S216.

In step S208, the coefficient $K_{PB}$ of PB correction which is the coefficient for correction by the negative pressure PB is retrieved. The coefficient $K_{PB}$ for PB correction is a coefficient that is smaller than 1 and used for multiplication of the fuel injection quantity, $T_{OUT}$ in order to make the air to fuel ratio thin during misfire. It is retrieved with the above-mentioned ΔPB as a parameter.

In step S209, the value obtained by multiplying the fuel injection quantity $T_{OUT}$ by the coefficient $K_{PB}$ is registered as a new fuel injection quantity. In step S210, the counter $N_{PI}$ of the number of times for PI correction is reset, and the coefficient $K_{PI}$ of correction by PI is set. Likewise in step S211 the flag $X_{HF}$ for previous misfire is set, and the counter $N_{HIGH}$ of the stretched-out condition correction and the flag $X_{HIGH}$ to show the existence of the stretched-out condition are set, and after this the present processing is finished.

On the other hand, when the PB correction is carried out for a specified period and the flag $X_{PI}$ for PI correction is set in step S214, the step proceeds from step S204 to step S215 in the next processing.

Likewise, when ignition is judged in the above-mentioned step S203, the step also proceeds to step S215 after the flag $X_{PI}$ for PI correction is reset in step S212.

In step S215, "10," for instance, is set to the counter $N_{PB}$ of the number of times for PB correction. In step S216 the opening, Θth of the throttle is checked and if it is over, for instance, 50%, the step proceeds to step S217, and if it is below 50%, the step proceeds to S227.

In step S221 the coefficient $K_{PI}$ of the PI correction is detected based on the detected indicated pressure, PI and in step S222 the value obtained by multiplying $K_{PI}$ by $K_{CPI}$ is registered as a new $K_{PI}$.

In step S223 the lower limit of $K_{PI}$ is checked, and if $K_{PI}<(0.95)^{29}$, $(0.95)^{29}$ is set to $K_{PI}$. In the way, the coefficient that is set to $K_{PI}$ as the lower limit value needs not be $(0.95)^{29}$. It can be a convenient value close to this value. It can be the lowest value of $K_{PI}$ that is registered as the coefficient of correction.

In step S224, the value obtained by multiplying the fuel injection quantity $T_{OUT}$ by the above-mentioned coefficient $K_{PI}$ of PI correction is registered as a new fuel injection quantity, $T_{OUT}$. After this the present processing proceeds to step S211, and if ignition is judged in the above-mentioned step S217, the present processing proceeds to step S230.

When the throttle opening, Θth is judged to be not below 50% and, further, in step S231 the engine's rotational speed, Ne is judged to be not less than 6,500 rpm, the misfire flag $X_{MF}$ is checked in step S232.

Further, when the throttle opening, Θth is below 50% or engine's speed, Ne is below 6,500 rpm, the present processing proceeds to step S244.

In step S232, if $X_{MF}=1$ does not hold, namely misfire was judged in the previous judging, the present processing proceeds to step S239 which will be described below. If misfire was judged in the previous judging ($X_{HF}=1$), the previous misfire flag $X_{MF}$ is reset in step S233.

In step S234, the counter $N_{mf}$ for the number of times of condition change from misfire to ignition is checked, and if $N_{mf}=0$ does not hold, the step proceeds to step S246, and here the $N_{mf}$ is incremented by 1 and then the step proceeds to step S239.

If $N_{mf}=0$, in step S235, "20," for instance, is cut from $N_{mf}$, and in step S236 the counter $N_{MF}$ of number of times of condition change from misfire to ignition is incremented by 1.

Namely, every time the condition change from misfire to ignition occurs 20 times and the counter $N_{mf}$ is 0, $N_{MF}$, the counter of misfire to ignition is incremented by 1.

In step S237, it is judged whether or not $N_{MF}$ exceeds an upper limit value that is set beforehand, and if it does not, the step proceeds to step S245, and here the coefficient $K_{MF}$ of misfire to ignition is set.

The coefficient $K_{MF}$ of misfire to ignition is a coefficient set for the purpose of gradually reducing the fuel injection quantity when the condition change from the state of misfire to the state of ignition occurs frequently, and the coefficient decreases according to the value of the counter $N_{MF}$ for the number of times of misfire to ignition. In the present embodiment it is calculated as $K_{MF}=(0.9)^{N}$ MF.

In the above-mentioned step S237, if it is judged that $N_{MF}$ exceeds the upper limit value, the upper limit value (MAX) is set to $N_{MF}$ in step S238. In step S239, the lower limit of $K_{MF}$ is checked, and if $K_{PI}<(0.9)^{MAX}$, $(0.9)^{MAX}$ is set to $K_{MF}$.

Meanwhile, the coefficient that is set to $K_{MF}$ as the lower limit value needs not necessarily be $(0.9)^{MAX}$. It can be a convenient value this value.

In step S240 the value obtained by multiplying the fuel injection quantity $T_{OUT}$ by the above-mentioned coefficient of misfire to ignition is registered as the new fuel injection quantity, $T_{OUT}$.

In step S241 the opening Θth of the throttle is checked, and here if it is judged that the throttle opening, Θth is not more than 90% or if in step S242 it is judged that the engine's rotational speed, Ne is not over 12,000 rpm, the present processing proceeds to step S243.

When the throttle opening, Θth is more than 90% and the engine's rotational speed is over the speed, for instance, 12,000 rpm, at which the engine's horsepower is at a peak, the stretched-out condition is judged and the present processing proceeds to step S247.

In step S247, the flag $X_{HIGH}$ for the stretched-out condition is checked, and if $S_{HIGH}=0$, namely the stretched-out condition is not being continued, 5 seconds, for instance, is set on the timer of the stretched-out condition in step S256, and the flag $X_{HIGH}$ is set in step S257.

The above-mentioned time $TM_{HIGH}$ of the stretched-out condition counts down as the time passes regardless of the present processing.

If the flag $X_{HIGH}=1$ for stretched-out condition in step S247, it is judged that the stretched-out condition is being continued, and the timer TMHIGH of the stretched-out condition is checked in step S248.

Here, if $TM_{HIGH}=0$ after five seconds without renewing after the timer setting, the flag $X_{HIGH}$ is reset in step S249, and in step S250 the counter $N_{HIGH}$ of the number of times for the stretched-out correction is incremented and the step proceeds to step S251.

In step S251 it is judged whether or not $N_{HIGH}$ exceeds the upper limit value that is beforehand set, and if it does not, the present processing proceeds to step S255, and here the coefficient, $K_{HIGH}$ of the stretched-out condition correction is set.

The coefficient $K_{HIGH}$ of stretched-out condition correction is a coefficient for increasing gradually the fuel injection quantity when the stretched-out condition continues and the coefficient increases in response to the value of $N_{HIGH}$, the counter of the number of times of the stretched-out correction.

In the present embodiment the coefficient is given by the formula, $K_{MF}=(1.1)^{N_{HIGH}}$ which corresponds to the value of $N_{HIGH}$. In the above-mentioned step S251, for $N_{HIGH}$ is judged to exceed the upper limit value (MAX), the upper limit value (MAX) is set to $N_{HIGH}$ in step S252.

In step S253 the upper limit of $K_{HIGH}$ is checked, and if $K_{HIGH}$ $(1\text{-}1)^{MAX}$, is set to $K_{HIGH}$. The coefficient that is set to $K_{HIGH}$ as the upper limit value needs not be necessarily $(1.1)^{MAX}$. It can be a convenient value approximate the value. In step S254 the value obtained by multiplying the fuel injection quantity, $T_{OUT}$ by the above-mentioned coefficient $K_{HIGH}$ of the stretched-out condition correction is registered as a new fuel injection quantity, $T_{OUT}$.

In the embodiment, the stretched-out condition is detected by the engine's rotational speed, Ne and the opening, Θth of the throttle so that the stretched-out condition can be detected without providing an exhaust gas temperature sensor, etc.

Because the basic fuel injection quantity is gradually corrected in response to the time of the continuation of the stretched-out condition, it becomes possible to obtain the most suitable air to fuel ratio in the stretched-out condition.

(2) PI correction processing

Figure 22:
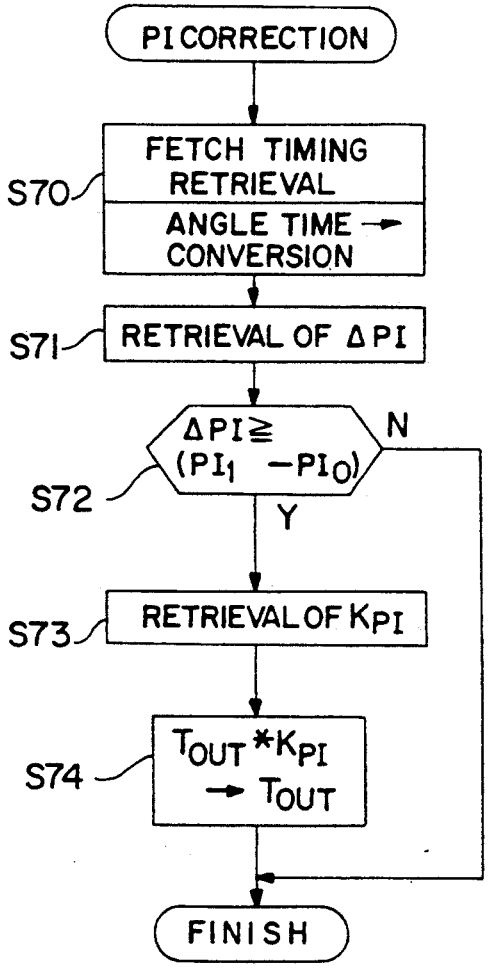
FIG. 22 is a flow chart to calculate the correction coefficient, $K_{PI}$.

The following will explain a method of calculating the coefficient $K_{PI}$ of PI correction with reference to FIG. 22. In step S70 the $PI_O$ fetch timing and PI; fetch timing (deg.) are retrieved from NE/PI fetch timing map in response to the engine's rotational speed, Ne.

Figure 24:
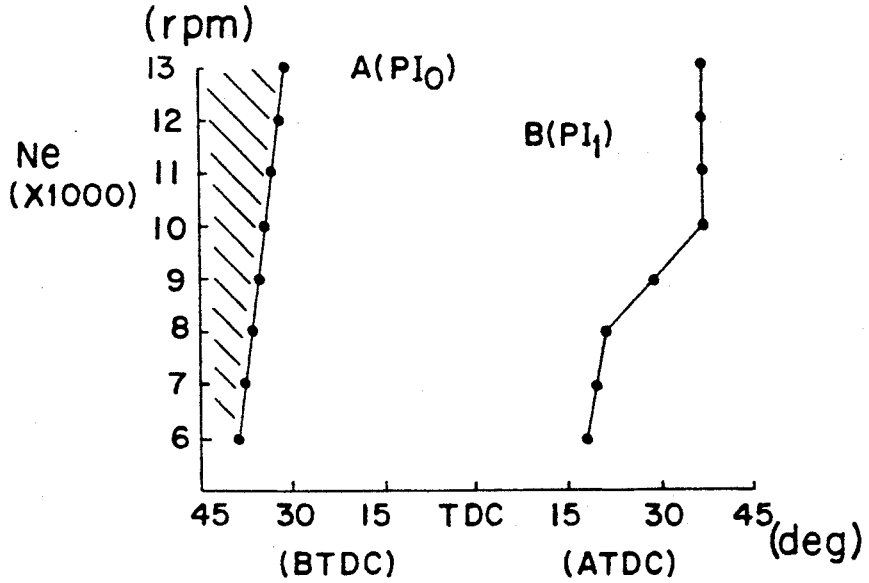
FIG. 24 is a graph to show the timing map to fetch Ne/PI.

FIG. 24 is the NE/PI fetch timing map, and the straight line A on the left side of the figure shows the relation between Ne and $PI_O$ fetch timing, and the broken line B on the right side of the figure shows the relation between Ne and $PI_I$ fetch timing.

It can be seen from FIG. 24 that in the embodiment the straight line B is higher on the right side. This means that the $PI_I$ fetch timing shifts backwards, to TDC side, as the engine's rotational speed, Ne increases.

In other words, the $PI_I$ fetch timing is set at the peak value of $PI_I$ or near it to be able to fetch $PI_I$ as large as possible in response to the engine's rotational speed, Ne.

In the embodiment, the straight line A is also higher on the right side. This means that as engine's rotational speed increases the $PI_O$ fetch timing is shifted backwards. The reason for this is as follows.

Figure 28A:
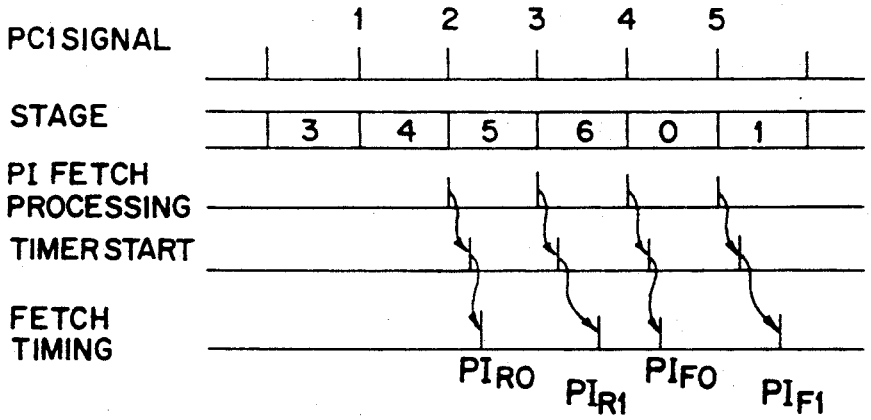
FIGS. 28A and 28B are a chart to explain the timing of fetching the indicated pressure PI.

As shown in FIG. 28A the fetch processing regarding $PI_{RO}$ is started by the timing of PC signal 2, and regarding $PI_{RI}$, $PI_{FO}$, $PI_{FI}$ they are respectively started by the timing of 3, 4, and 5.

Figure 18:
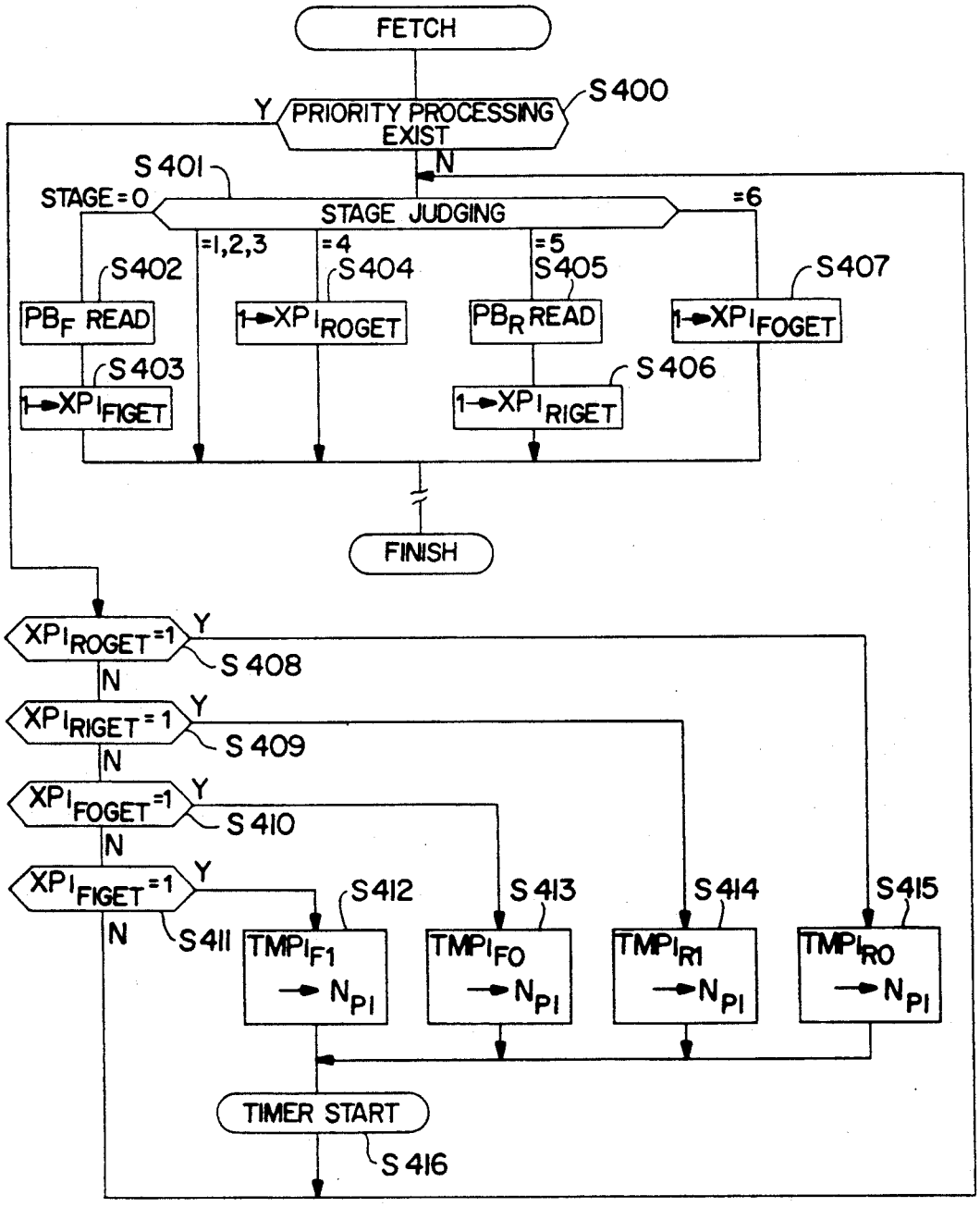
FIG. 18 is a flow chart of PI fetch timing correction.
Figure 19:
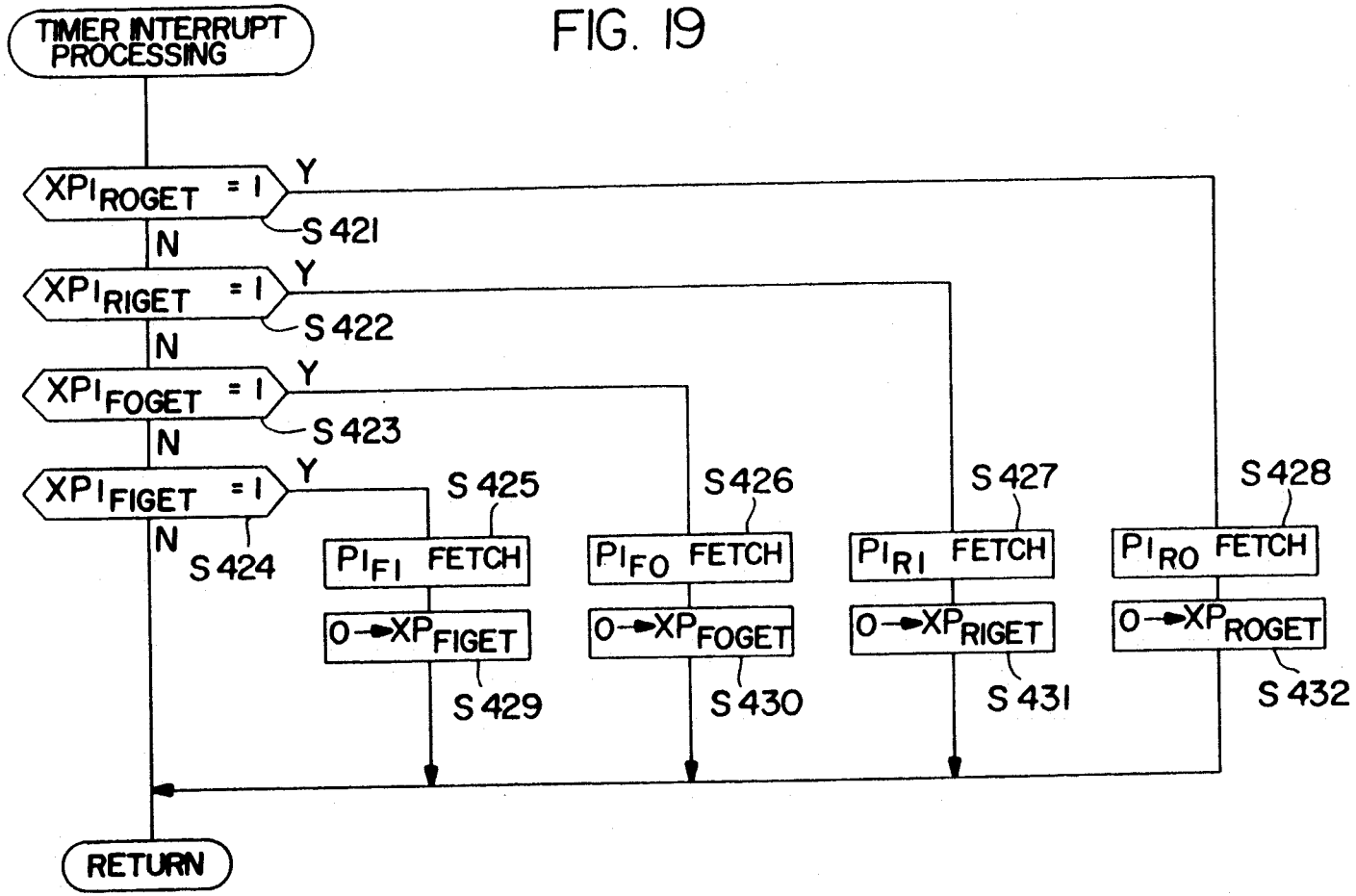
FIG. 19 is a flow chart of the timer interrupt.

When PI fetch processing is started, the processing which is explained regarding the above-mentioned FIG. 18 is carried out progressively, and when it proceeds to a specified step (S416), the timer starts counting, and when the count value becomes "0," the interrupt processing which was explained regarding FIG. 19 is carried out, and when the step proceeds to a specified step, the fetch processing is carried out.

In order to increase the indicated pressure difference between indicated pressure difference PI and $(PI_I-PI_O)$ which becomes a standard value in misfire judging, the $PI_O$ fetch timing should be earlier as is obvious from FIG. 17, but in the time from detecting a specified PC signal to the execution of the fetch processing, the time spent for various calculations and the count time of the timer intervene so that it is inevitable that the PI fetch timing, angle, is shifted backwards as the engine's rotational speed, Ne increases.

Figure 28B:
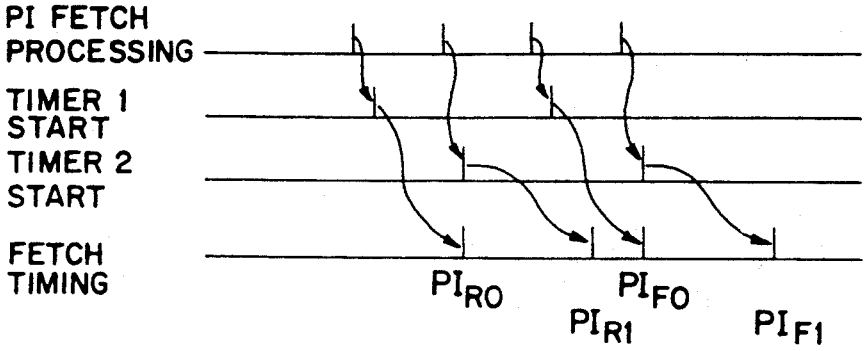

In order to remove the shifts of $PI_O$ fetch timing, two timers are provided for detecting timing as shown in FIG. 28B. The fetch processing regarding $PI_{RO}$ is started by the timing of 1 of the PC signals. Regarding $PI_{RI}$, $PI_{FO}$, $PI_{FI}$ they can be respectively started by timing of 2, 3 and 4. In this way the $PI_O$ timing can be assigned a fixed value.

When PI fetch timing is retrieved in the way explained above, the timing is converted from an angle to time, and the fetch timings $PI_O$ and $PI_I$ of the front bank are registered as $TM_{PI}FO$ and $TMPI_{FI}$ which are explained regarding steps S412 and S413. In the same way the fetch timing of the rear bank, $PI_O$ and $PI_I$ are registered as $TMPI_{RO}$ and $TMPI_{RI}$ which are explained respectively regarding step S414 and S415.

In step S71, indicated pressure difference PI which is set beforehand according to Ne and Θth and becomes the standard value of the misfire judging, is retrieved. In step S72, ΔPI and $(PI_I-PI_O)$ are compared, and if $\Delta PI \geqq (PI_I-PI_O)$, namely misfire is judged, the coefficient $K_{PI}$ of correction is retrieved in step S73.

In the misfire detection by means of indicated pressure PI, the volume of air sucked into the engine during misfire cannot be estimated so that the coefficient $K_{PI}$ of correction is calculated based on the intake ratio L during misfire.

Figure 23:
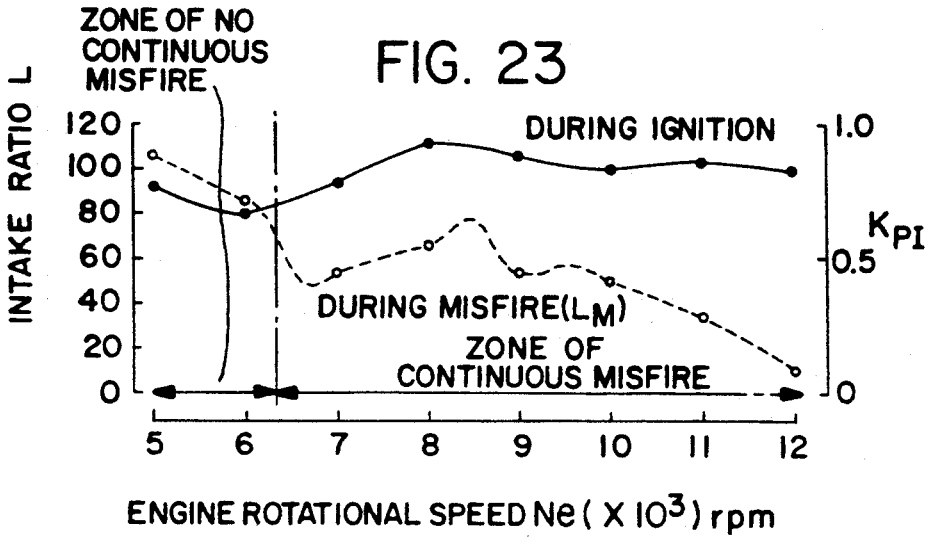
FIG. 23 is a graph to show the air to fuel ratio L intake at the times of ignition and misfire.

FIG. 23 is a graph to show the intake ratio $L_F$ during ignition and intake ratio $L_M$ during misfire. It can be seen from FIG. 23 that the intake ratio in the zone where misfire occurs continuously and the intake ratio in the zone where misfire does not occur are mutually opposed. In the zone where misfire occurs the intake ratio $L_F$ at the time of ignition is larger than the intake ratio $L_M$ at the time of misfire. In the embodiment the coefficient $K_{PI}$ of corrosion adopts $L_M/L_F$.

Since the above-mentioned PI correction is a supplementary correction for the case in which the PB correction does not succeed in eliminating misfire, $K_{PI}<K_{PB}$ should hold. Further, for sure ignition $K_{PI} \geqq (L_M/L_F)$ should be established, so that $K_{PI}$ should satisfy the following formula:

$$(L_M/L_F) \leqq K_{PI} < K_{PB}$$

In the embodiment the coefficient $K_L$ which satisfies the following formula is set in order to make $K_{PI}$ satisfy the above formula, and $K_L \times (L_M/L_F)$ is made the coefficient $K_{PI}$ of correction.

$$(L_M/L_F) \leqq K_L \times (L_M/L_F) < K_{PB}$$

In step S74 the fuel injection quantity $T_{OUT}$ is multiplied by the coefficient $K_{PI} \times K_L \times (L_M/L_F)$ of correction to obtain a new fuel injection quantity.

In the above explanation the coefficient $K_{PI}$ of correction was calculated based on $L_M/L_F$, but in the zone where misfire occurs the intake ratio $L_F$ is almost 100% as seen from FIG. 23. In addition, the effect that is the same as mentioned above is obtained even if the coefficient $K_{PI}$ of correction is calculated based on only the intake ratio $L_M$.

In the embodiment it was explained that the detection timing by indicated pressure was angularly delayed as the engine's rotational speed increased, but the detection timing can be angularly delayed by detecting the ignition timing and in response to the angular delay of the ignition timing.

(3) Engine brake correction processing

Engine brake correction is designed to increase the fuel injection quantity and improve the effect of engine braking. In view of the judgement that the conditions of high Ne and small opening Θth are caused by the condition of engine braking, the purpose of eliminating faulty deceleration in which the volume of intake does not decrease in proportion to the opening Θth during deceleration by engine braking occurs. The air to fuel ratio becomes thin and satisfactory deceleration is not given.

Figure 25:
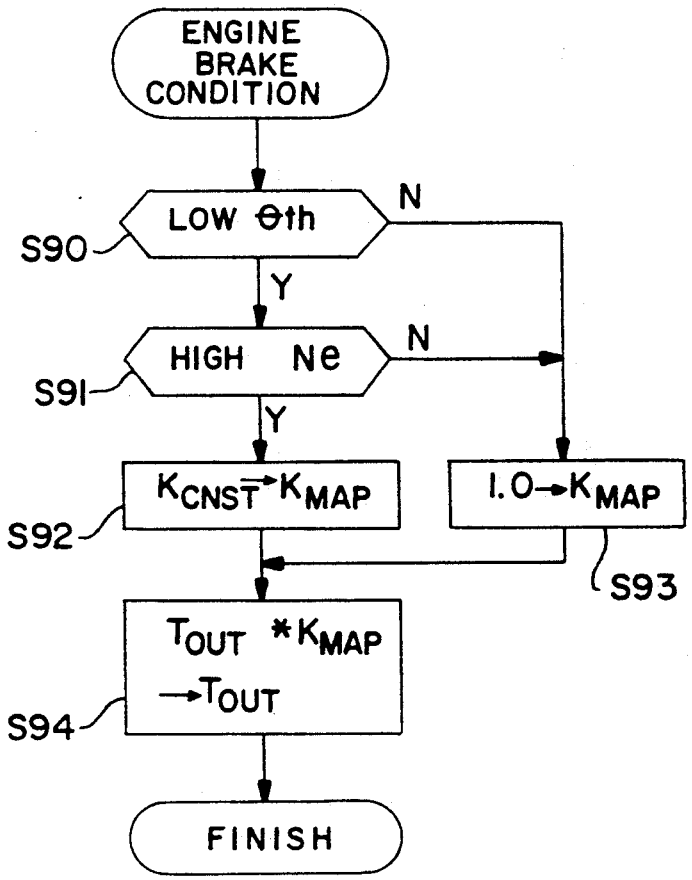
FIG. 25 is a flow chart of engine break correction processing.

In the following, engine brake correction processing will be explained by using the flow chart of FIG. 25. If in step S90, the throttle opening Θth is judged to be small and if in step S91, the engine's rotational speed, Ne is judged to be high, a constant $K_{cnst}$ is beforehand set to the coefficient $K_{MAP}$.

Further, in the case in which the opening Θth is not small and the rotational speed, Ne is not high, "1" is set to the coefficient $K_{MAP}$ in step S93.

In step S94, the fuel injection quantity, $T_{OUT}$ is multiplied by the coefficient $K_{MAP}$ correction to obtain a new fuel injection quantity and it is registered as $T_{OUT}$.

According to the engine brake correction, the condition of engine braking with a small opening, Θth is supplied with a suitable amount of fuel so that the effect of engine braking can be improved.

Returning to FIG. 19 again it is judged whether or not the engine is being cranked in step S23. If it is, the fuel injection quantity Ti is retrieved at the time of cranking, about two revolutions of the crank shaft from completion of starting to warm-up operation, by using the cooling water temperature Tw from the cranking table in step S24. In step S25 the Ti retrieved in step S24 is stored in the memory at a specified register.

On the other hand, if it is judged in step S23 that the engine is not being cranked, the basic fuel injection quantity Ti for the warming-up of the engine or ordinary operation is retrieved from the map which has, for example, engine's rotational speed, Ne and the opening, Θth of the throttle as parameters in step S26.

In step S27, the fuel injection quantity Ti that is retrieved in step S26 is stored in the memory at a specified register as in step S25 and the present processing proceeds to step S28.

In step S28, the fuel injection quantity $T_{OUT}$ is calculated and in step S29, this calculated quantity is outputted.

As explained in FIG. 2 and FIG. 3, only one fuel injector is provided in this embodiment so that it is difficult to regulate the injected fuel quantity exactly either at the time of a low engine speed, Ne or at the time of high engine speed.

In the embodiment, therefore, an intermittent fuel injection control is adopted for the fuel injection.

Figure 26:
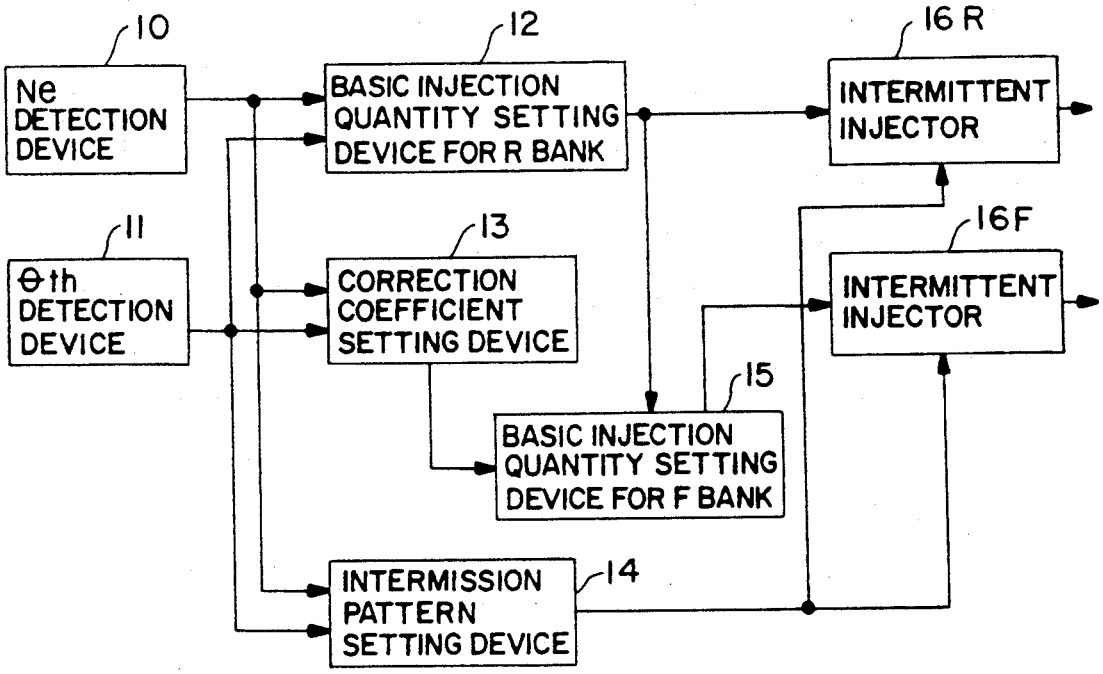
FIG. 26 is a block diagram of an intermittent injection control device.

FIG. 26 is a block diagram of the intermittent injection control device of an embodiment of the invention. In this figure, the engine's rotational speed, Ne, and the opening, Θth, of the throttle detected respectively by an engine rotational speed detection device and throttle opening detection device, are inputted to a rear R bank basic injection quantity setting device 12, correction coefficient setting device 13, and intermittent pattern setting device 14.

The rear R bank basic injection quantity setting device 12 retrieves a fuel injection quantity $Ti_R$ most suitable for the cylinder from the R map and outputs it to the above-mentioned injection quantity $Ti_R$ and intermittent injection device 16 R.

On the other hand, the following formula (1) is established between the rear map and front map:

$$Fmap - Rmap \times K_{NM} \ldots \quad (1)$$

The most suitable fuel injection quantity can be, therefore, given simply by seeking the Fmap by multiplying the Rmap by the correction coefficient $K_{NM}$ without setting the Fmap.

Now, in this embodiment the correction coefficient setting device 13 calculates the correction coefficient $K_{NM}$ to obtain the most suitable fuel injection quantity for the front cylinder from the fuel injection quantity $Ti_R$ that is given by the above-mentioned basic injection quantity setting device for the rear R bank, and the device 13 outputs the calculated coefficient $K_{NM}$ to the basic injection quantity setting device 15 of the front F bank.

The front F bank basic injection quantity setting device 15 multiplies injection quantity $Ti_R$ by the correction coefficient $K_{NM}$ to calculate injection quantity $Ti_F$ and outputs this injection quantity $Ti_F$ to the intermittent injection device 16F.

Figure 27A:
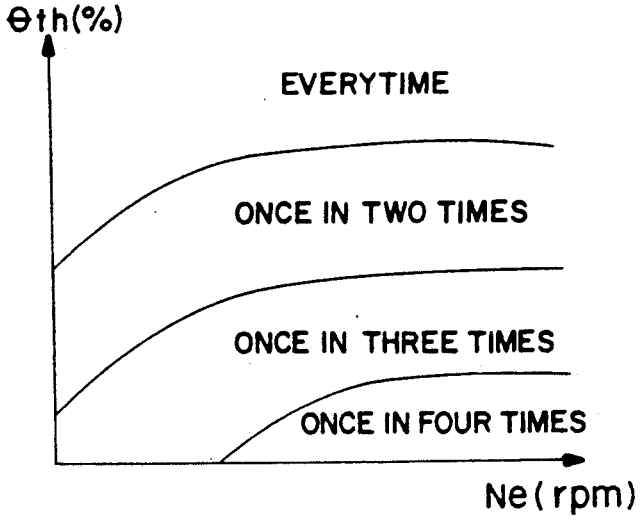
FIG. 27A and FIG. 27B are graphs illustrating the intermittent injection control device.

The intermission pattern setting device 14 sets an intermission pattern from the data table in FIG. 27A with the throttle opening Θth and the engine's rotational speed Ne as parameters. The set pattern is outputted to intermittent injection device 16F and 16R.

The intermittent injection device 16F and 16R output two times the respective injection quantities $Ti_F$ and $Ti_R$ at the rate of one in two injections if the intermission pattern is one in two injections, and the devices 16F and 16R output four times at the rate of once in four injections if the intermission pattern is one in four injections.

By the intermittent injection above explained, about n-times as much as the basic injection quantity is injected once in n-times in accumulation, so that an ample amount of fuel is injected even in a high engine speed and under a high load. It is possible to deliver the fuel from a high load. In addition, it is possible to deliver the fuel from engine idling to high rotation and to a high load in the most suitable quantity. Furthermore, the number of intermittent rotation n is set according to the engine rotational speed and the throttle opening, so that desirable acceleration and deceleration can be obtained from engine idling to sudden engine acceleration due to sudden opening of the throttle, and to sudden deceleration due to sudden closing of the throttle valve.

In the embodiment of the above-mentioned intermittent injection, the basic fuel injection quantity of the front F bank is calculated by multiplying the basic fuel injection quantity of the rear bank by the correction coefficient. On the contrary, the basic fuel injection quantity of the rear bank can be calculated by multiplying the basic fuel injection quantity of the front bank by the correction coefficient.

When the present invention is applied to an ordinary straight type engine instead of a V-type engine, the correction coefficient setting device 13, basic injection quantity setting device 15 of the front bank and intermittent injection device 16F can be omitted.

Figure 27B:
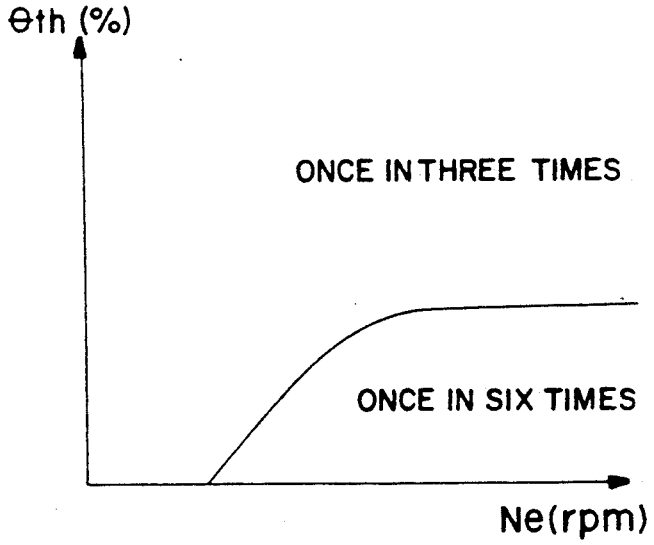

The intermission pattern of the intermittent injection is not limited to the one described hereinabove. For instance, as shown in FIG. 27B an intermission pattern in which the injection is intermittent in the whole range can be used.

With such intermission pattern, intermittent injection can be made in the whole range of operation of the engine and the control of the timing of fuel injection, calculation of the injection quantity, etc. are to be made once in n-times.

Consequently, the time used for making various calculations is shortened and the system can have more room for maneuver. This is particularly true for a high rotational speed of the engine, making the system design easy.

FIG. 1 is a block diagram of the functions of this embodiment of the invention, and the same numerals and symbols are used as before, denoting the same or similar parts.

In FIG. 1 the throttle opening, Θth detection device 101 detects the opening, Θth, of the throttle. The rotational speed, Ne detection device 102 of the engine detects the engine's rotational speed, Ne by using the Ne pulse that is outputted from the Ne pulse generating device 100. The injection timing control device 103 sets fuel injection timing by using the Ne pulse. The basic fuel injection quantity setting device 104 sets basic fuel injection quantity Ti based on the engine's rotational speed, Ne.

The acceleration initial judging device 107 detects sudden opening of the throttle from its low opening based on the opening Θth and ΔΘth. The engine brake detection device 108 detects the deceleration caused by engine braking based on the opening Θth and speed Ne. The reducing correction device 112 outputs reduction coefficient $K_{ACC}$ which reduces the above-mentioned fuel injection quantity Ti at the beginning of acceleration. The increasing correction device 113 outputs increase coefficient $K_{MAP}$ which increases the above-mentioned fuel injection quantity Ti at the time of deceleration.

A stretched-out condition detection device 109 measures the time of duration of the stretched-out condition at a high engine's rotational speed and with a large opening Θth. The increasing correction device 114 outputs the coefficient of increasing correction which increases the above-mentioned fuel injection quantity according to the time of duration of the stretched-out condition.

The deterioration judging device 126 judges the state of deterioration of the engine based on the throttle opening Θth and engine's rotational speed, Ne. The increasing and reducing correction device 127 outputs coefficient $K_{LFS}$ which increases and reduces the above-mentioned fuel injection quantity Ti according to the state of deterioration of the engine.

The intermittent injection control device 123 injects fuel intermittently based on the throttle opening Θth and engine's rotational speed, Ne.

The PB detection timing output device 124 and PI detection timing output device 125 output respective negative pressures PB for detection timing and indicated pressure Pi detection timing based on the engine's rotational speed Ne.

The PB sensor 115 detects the pressure in the intake pipe. The PI sensor 116 detects the pressure in the combustion chamber.

The misfire judging standard output device 111 outputs misfire judging standard value regarding the pressure in the intake pipe and the combustion chamber.

The first misfire judging device 117 judges the state of combustion based on a detected value of the PB sensor 115 and the above-mentioned misfire judging standard value. The counter 118 of the number of times of PB misfire counts the number of times of misfire judging by the first misfire judging device 117. The reducing correction device 120 outputs the coefficient reducing correction which reduces the above-mentioned fuel injection quantity Ti at the time when misfire is judged.

The second misfire judging device 119 detects either one of the ignition judging by the judging device 117, or the condition wherein the number of times of the above-mentioned misfire judging has reached a planned number of times, and judges the state of combustion based on detected value of the indicated pressure sensor 116 and the above-mentioned misfire judging standard value.

The counter 122 of the number of times of PI misfire counts the number of times of misfire judgements by the second misfire judging device 119. The reducing correction device 121 outputs the coefficient $K_{PI}$ of the reducing correction, which reduces the above-mentioned fuel injection quantity Ti based on the counted value of the counter of the number of times of PI misfire.

The condition change judging device 128 judges the change in the condition from misfire to ignition. The counter 130 of the number of times of condition changes counts the number of times of condition change judging from the above-mentioned misfire to ignition. The reduction correction device 129 outputs the coefficient $K_{MF}$ of reducing correction, which reduces the above-mentioned fuel injection quantity based on the count value of the counter 130 of the number of times of condition changes.

The fuel injection quantity determination device 105 determines fuel injection quantity $T_{OUT}$ by multiplying the basic fuel injection quantity Ti by the above-mentioned coefficient of reducing correction and the coefficient of increasing correction. The driving device 106 controls the time of electric current passage to the injector 51 based on the above-mentioned fuel injection quantity, $T_{OUT}$.

It will be obvious that the following favorable results will be obtained from embodiments of the invention. Even when the condition of misfire is changed to ignition, the basic fuel injection quantity is reduced so that, when, as at the time right after the condition of misfire is changed to the condition of ignition, the fuel-air mixture returns to the condition in which the fuel-air mixture is prone to misfire, the misfire can be surely eliminated because the fuel injection quantity is reduced.

The fuel injection quantity is gradually corrected to reduce the quantity according to the number of times of condition change from misfire to ignition and the air to fuel ratio is made to be nearer to the condition in which ignition is stably made. Misfire can be, therefore, surely be eliminated further.

Even when the condition is changed from misfire to ignition with the engine's rotational speed low and the opening of the throttle small, care is taken that the above-mentioned correction to a reduced fuel injection is not effected. Consequently the air to fuel ratio never becomes thin.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection quantity control device for use with a two cycle engine being rotatably driven by receiving a fuel-air mixture injected into the engine based on fuel injection quantity instruction signals and the air supplied through an intake passage and ignition of the fuel-air mixture in a combustion chamber comprising:

a rotational speed Ne detection device for detecting the rotational speed Ne of the two cycle engine and for generating a rotational speed Ne signal;

an opening Θ detection device for detecting the opening Θ of a throttle provided in an intake passage for regulating the supply of air and for generating an opening Θ signal;

a basic injection quantity setting device for setting a basic injection quantity of the fuel based on the rotational speed, Ne signal and the opening Θ signal;

a fuel-air mixture condition judging device for judging the conditions of the fuel-air mixture; and an injection quantity instruction signal generating device for correcting the basic injection quantity to reduce the quantity in response to misfire in said fuel-air mixture for changing the conditions of the fuel-air mixture to ignition, and for outputting the corrected basic injection quantity as an injection quantity instruction signal;

said fuel-air mixture condition judging device judges a misfire condition at the present time based on a previous judgment of a misfire condition in the past.

2. The fuel injection quantity control device according to claim 1, wherein the fuel-air mixture condition judging devices comprises:

a negative pressure PB detection section for generating a negative pressure PB signal by detecting negative pressure in said intake passage;

an indicated pressure PI detection section for detecting the indicated pressure PI in said combustion chamber and for generating an indicated pressure PI signal;

a first misfire judging section for judging based on said negative pressure PB signal whether or not misfire exists in said fuel-air mixture; and a second misfire judging section for judging based on said indicated pressure PI signal whether or not misfire exists in said fuel-air mixture; and said injection quantity instruction generating device comprises:

a first correction section for correcting said basic injection quantity to reduce the injection when said first misfire judging section judges misfire; and a second correction section for correcting said basic injection quantity to reduce the injection when said second misfire judging section judges misfire; and said first correction section reduces said basic injection quantity by a quantity smaller than the quantity in said second correction section.

3. The fuel injection quantity control device according to claim 2, wherein said injection quantity instruction signal generating device comprises a first counter of the number of times of misfire which counts the number of times of misfire judging by said first misfire judging section and outputs a first signal of the number of times of misfire, and said second misfire judging section judges whether or not said fuel-air mixture has misfired when said first signal of the number of times of misfire is more than a standard number of times of misfire that is beforehand specified.

4. The fuel injection quantity control device according to claim 2, wherein said first correction section corrects said basic injection quantity to reduce the quantity based on the difference of said negative pressure PB signal and a standard negative pressure PB value that is beforehand specified.

5. The fuel injection quantity control device according to claim 2, wherein said second correction section corrects said basic injection quantity to reduce the quantity based on said rotational speed Ne signal.

6. The fuel injection quantity control device according to claim 2, wherein said injection quantity instruction signal generating device includes a second counter of the number of times of misfire which counts the number of times of misfire judged as misfire by said second misfire judging device and outputs a second signal of the number of times of misfire, and said second correction section corrects said basic injection quantity in response to said second signal of the number of times of misfire.

7. The fuel injection quantity control device according to claim 2, wherein said fuel-air mixture condition judging device includes a judging section for condition change from misfire to ignition and said injection quantity instruction signal generating device has a third correction device which corrects said basic injection quantity to reduce the quantity.

8. The fuel injection quantity control device according to claim 7, wherein said fuel-air mixture condition judging device includes a counter of the number of times of condition change to count the number of times of said condition change judging and said third correction device corrects said basic injection quantity to reduce the quantity in response to said number of times of condition change judging.

9. The fuel injection quantity control device according to claim 1, wherein said fuel injection quantity control device further comprises:

a stretched-out condition detection device for detecting high-load condition of said two cycle engine, and outputs a stretched-out condition signal;

a continuation time counter means for receiving said stretched-out condition signal and for counting reception continuation time of said stretched-out condition signal and for outputting stretched-out time signal; and an injection quantity instruction signal generating device for correcting said basic injection quantity to increase the quantity based on said stretched-out time signal and outputs said corrected basic injection quantity as said injection quantity instruction signal.

10. The fuel injection quantity control device according to claim 9, wherein said stretched-out condition detection device judges as said stretched-out condition a beforehand specified high engine rotational speed and a beforehand specified high throttle opening.

11. A fuel injection quantity control device for a two-cycle engine for providing an angular delay in ignition timing for the fuel-air mixture in the combustion chamber at the time of a high rotational speed of said engine, and includes a rotational speed Ne detection device for detecting the rotational speed Ne of said two cycle engine and for generating rotational speed Ne signal, and an indicated pressure PI in said combustion chamber and for generating an indicated pressure PI signal, comprising:

a detection timing setting section for setting detection timing of said indicated pressure PI detection section based on said rotational speed Ne signal.

12. The fuel injection quantity control device according to claim 11, wherein said detection timing setting section sets said detection timing at least after a top dead center with a delay when said rotational speed Ne signal has a value over a standard rotational speed value.

13. The fuel injection quantity control device according to claim 11, and further including a misfire judging section for judging based on said indicated pressure PI signal in response to said detection timing whether or not misfire of said fuel-air mixture exists.

14. The fuel injection quantity control device according to claim 13, wherein a misfire judging standard value output device is provided for outputting misfire judging standard value beforehand specified in response to the operation conditions of said two cycle engine, and said misfire judging section judges based on the difference of said indicated pressure PI signal and said misfire judging standard value whether or not misfire exists in said fuel-air mixture.

15. A fuel injection quantity control device for use with a two cycle engine being rotatably driven by receiving a fuel-air mixture injected into the engine based on fuel injection quantity instruction signals and the air supplied through an intake passage and ignition of the fuel-air mixture in a combustion chamber comprising:

a rotational speed Ne detection device for detecting the rotational speed Ne of the two cycle engine and for generating a rotational speed Ne signal;

an opening Θ detection device for detecting the opening Θ of a throttle provided in an intake passage for regulating the supply of air and for generating an opening Θ signal;

a basic injection quantity setting device for setting a basic injection quantity of the fuel based on the rotational speed, Ne signal and the opening Θ signal;

a fuel-air mixture condition judging device for judging the conditions of the fuel-air mixture; and an injection quantity instruction signal generating device for correcting the basic injection quantity to reduce the quantity in response to misfire in said fuel-air mixture for changing the conditions of the fuel-air mixture ignition, and for outputting the corrected basic injection quantity as an injection quantity instruction signal;

said fuel-air mixture condition judging device judges a misfire at the present time based on a misfire in the past;

said fuel-air mixture condition judging devices comprises:

a negative pressure PB detection section for generating a negative pressure PB signal by detecting negative pressure in said intake passage;

an indicated pressure PI detection section for detecting the indicated pressure PI in said combustion chamber and for generating an indicated pressure PI signal;

a first misfire judging section for judging based on said negative pressure PB signal whether or not misfire exists in said fuel-air mixture; and a second misfire judging section for judging based on said indicated pressure PI signal whether or not misfire exists in said fuel-air mixture; and said injection quantity instruction generating device comprises:

a first correction section for correcting said basic injection quantity to reduce the injection when said first misfire judging section judges misfire; and a second correction section for correcting said basic injection quantity to reduce the injection when said second misfire judging section judges misfire; and said first correction section reduces said basic injection quantity by a quantity smaller than the quantity in said second correction section.

16. The fuel injection quantity control device according to claim 15, wherein said injection quantity instruction signal generating device comprises a first counter of the number of times of misfire which counts the number of times of misfire judging by said first misfire judging section and outputs a first signal of the number of times of misfire, and said second misfire judging section judges whether or not said fuel-air mixture has misfired when said first signal of the number of times of misfire is more than a standard number of times of misfire that is beforehand specified.

17. The fuel injection quantity control device according to claim 15, wherein said first correction section corrects said basic injection quantity to reduce the quantity based on the difference of said negative pressure PB signal and a standard negative pressure PB value that is beforehand specified.

18. The fuel injection quantity control device according to claim 15, wherein said second correction section corrects said basic injection quantity to reduce the quantity based on said rotational speed Ne signal.

19. The fuel injection quantity control device according to claim 15, wherein said injection quantity instruction signal generating device includes a second counter of the number of times of misfire which counts the number of times of misfire judged as misfire by said second misfire judging device and outputs a second signal of the number of times of misfire, and said second correction section corrects said basic injection quantity in response to said second signal of the number of times of misfire.

20. The fuel injection quantity control device according to claim 15, wherein said fuel-air mixture condition judging device includes a judging section for condition change from misfire to ignition and said injection quantity instruction signal generating device has a third correction device which corrects said basic injection quantity to reduce the quantity.

21. The fuel injection quantity control device according to claim 20, wherein said fuel-air mixture condition judging device includes a counter of the number of times of condition change to count the number of times of said condition change judging and said third correction device corrects said basic injection quantity to reduce the quantity in response to said number of times of condition change judging.

22. A fuel injection quantity control device for use with a two cycle engine being rotatably driven by receiving a fuel-air mixture injected into the engine based on fuel injection quantity instruction signals and the air supplied through an intake passage and ignition of the fuel-air mixture in a combustion chamber comprising:

a rotational speed Ne detection device for detecting the rotational speed Ne of the two cycle engine and for generating a rotational speed Ne signal;

an opening Θ detection device for detecting the opening Θ of a throttle provided in an intake passage for regulating the supply of air and for generating an opening Θ signal;

a basic injection quantity setting device for setting a basic injection quantity of the fuel based on the rotational speed, Ne signal and the opening Θ signal;

a fuel-air mixture condition judging device for judging the conditions of the fuel-air mixture; and an injection quantity instruction signal generating device for correcting the basic injection quantity to reduce the quantity in response to misfire in said fuel-air mixture for changing the conditions of the fuel-air mixture to ignition, and for outputting the corrected basic injection quantity as an injection quantity instruction signal;

said fuel-air mixture condition judging device judges a misfire at the present time based on a misfire in the past;

said fuel injection quantity control device further comprises:

a stretched-out condition detection device for detecting based on said rotational speed Ne signal and said opening signal said stretched-out condition of said two cycle engine, and outputs a stretched-out condition signal;

a continuation time counter for receiving said stretched-out condition signal and for counting reception continuation time of said stretched-out condition signal and for outputting stretched-out time signal; and an injection quantity instruction signal generating device for correcting said basic injection quantity to increase the quantity based on said stretched-out time signal and outputs said corrected basic injection quantity as said injection quantity instruction signal.

23. The fuel injection quantity control device according to claim 22, wherein said stretched-out condition detection device judges as said stretched-out condition a beforehand specified high engine rotational speed and a beforehand specified high throttle opening.

* * * * *